US005139472A

United States Patent [19]

Caruthers

[11] Patent Number: 5,139,472

[45] Date of Patent: Aug. 18, 1992

[54] EXERCISE DEVICES

[75] Inventor: Scott Caruthers, Millersville, Md.

[73] Assignee: Dar Products Corporation, Baltimore, Md.

[21] Appl. No.: 470,616

[22] Filed: Jan. 26, 1990

Related U.S. Application Data

[63] Continuation-in-part of Ser. No. 241,297, Sep. 9, 1988, Pat. No. 4,896,880, which is a continuation-in-part of Ser. No. 94,794, Sep. 14, 1987, Pat. No. 4,813,669.

[51] Int. Cl.[5] ..... A63B 21/06

[52] U.S. Cl. ..... 482/93; 482/139

[58] Field of Search ..... 272/67, 68, 117, 119, 272/123, 124, 143; D21/197, 198; 212/122

[56] References Cited

U.S. PATENT DOCUMENTS

| | | | |
|---|---|---|---|
| D. 26,418 | 12/1896 | Heydrick . | |
| D. 215,057 | 8/1969 | Sun . | |
| D. 221,874 | 9/1971 | Collins, Jr. et al. . | |
| D. 223,843 | 6/1972 | Li . | |
| D. 242,865 | 12/1976 | Stamm . | |
| D. 244,628 | 6/1977 | Wright . | |
| D. 244,629 | 6/1977 | Wright . | |
| 259,752 | 6/1882 | Fisher, Jr. . | |
| D. 264,625 | 5/1982 | Shiu . | |
| D. 267,737 | 1/1983 | Wright . | |
| D. 268,437 | 3/1983 | Giordano . | |
| D. 273,030 | 3/1984 | Anderson . | |
| D. 274,283 | 6/1984 | Wright . | |
| 654,097 | 7/1900 | Sandow . | |
| 714,463 | 11/1902 | Duffner . | |
| 1,229,658 | 6/1917 | Sandow . | |
| 1,316,683 | 9/1919 | Calvert . | |
| 1,749,632 | 3/1930 | Ferris . | |
| 1,918,142 | 7/1933 | Smith . | |
| 3,231,270 | 1/1966 | Winer . | |
| 3,924,851 | 12/1975 | Winston | 272/67 |
| 4,029,312 | 6/1977 | Wright | 272/122 X |
| 4,218,057 | 8/1980 | Wilson | 272/117 |
| 4,361,324 | 11/1982 | Baroi | 272/122 X |
| 4,623,143 | 11/1986 | Wuellenweber | 272/143 X |
| 4,627,618 | 12/1986 | Schwartz | 272/122 |
| 4,695,051 | 9/1987 | Jenison | 272/122 |
| 4,778,173 | 10/1988 | Joutras | 272/122 X |

*Primary Examiner*—Robert Bahr
*Attorney, Agent, or Firm*—Leonard Bloom

[57] ABSTRACT

An exercise device is intended for strengthening a user's targeted muscle, wherein the user may manipulate the device without the necessity of a forceful grip that employs the user's conjunctive muscles. The device includes a housing having a pair of diametrically-opposed portions (preferably hemispherical) each of which has a peripheral edge. The peripheral edges are formed having alternating tongue and groove segments so as to provide a solid mating relationship therebetween. A single weight is disposed in the housing, and the weight has a pair of opposite ends, each of which is secured to a respective diametrically opposed portion of the housing. The housing has an opening formed therein defined by the walls of the device. An insert is disposed in the opening to cushion the user's hand in the opening.

21 Claims, 26 Drawing Sheets

EXERCISE DEVICES

CROSS-REFERENCE TO RELATED APPLICATION

This application is a continuation-in-part of co-pending application Ser. No. 241,297 filed on Sep. 9, 1988, U.S. Pat. No. 4,896,880, which in turn is a continuation-in-part of application Ser. No. 094,794 filed Sep. 14, 1987 (which issued on Mar. 21, 1989 as U.S. Pat. No. 4,813,669) the disclosures of which are incorporated by reference herein in their entirety.

FIELD OF THE INVENTION

The present invention relates to exercise devices, and more particularly, to exercise devices intended for the accelerated development and strengthening of a user's targeted muscle or muscles, as well as a method for the assembly and production of the exercise devices.

BACKGROUND OF THE INVENTION

The use of specialized equipment and various mechanical apparatuses for strengthening muscles is well known. Moreover, the desirability of providing a device which is capable of isolating and developing a specifically targeted muscle, one of the most common of which is the bicep, has also been long recognized.

However, one of the most troublesome problems presented with providing a device that can isolate and fully develop a muscle, such as the bicep, is that any sort of gripping and grasping action with the hand automatically employs the conjunctive muscles of the arm, including the forearm, tricep and deltoid. The same problem is encountered for the exercise and strengthening of other muscles in the body.

Unfortunately, each of the apparatuses and devices resorted to in the prior art for developing a specifically targeted muscle, such as the bicep, provide for some sort of handle which must be gripped and/or grasped by the user thereof. Examples of these devices are enumerated as follows:

| Inventor(s) | Patent No. | Year Issued |
|---|---|---|
| Fisher | 259,752 | 1882 |
| Heydrick | D 26,418 | 1896 |
| Sandow | 654,097 | 1900 |
| Duffner | 714,463 | 1902 |
| Sandow | 1,229,658 | 1917 |
| Calvert | 1,316,683 | 1919 |
| Ferris | 1,749,632 | 1930 |
| Smith | 1,918,142 | 1933 |
| Winer | 3,231,270 | 1966 |
| Sun | D 215,057 | 1969 |
| Collins, Jr. et al | D 221,874 | 1971 |
| Li | D 223,843 | 1972 |
| Stamm | D 242,865 | 1976 |
| Wright | D 244,628 | 1977 |
| Wright | D 244,629 | 1977 |
| Wright | 4,029,312 | 1977 |
| Shin | D 264,625 | 1982 |
| Baroi | 4,361,324 | 1982 |
| Wright | D 267,737 | 1983 |
| Giordano | D 268,437 | 1983 |
| Anderson | D 273,030 | 1984 |
| Wright | D 274,283 | 1984 |
| Schwartz | 4,627,618 | 1986 |
| Jenison | 4,695,051 | 1987. |

This gripping and/or grasping action required by each of these devices is a definite disadvantage, since it involves the use of conjunctive muscles which prevents isolation required for the total development of the targeted muscle.

More specifically, every piece of exercise equipment or mechanical apparatus heretofore resorted to in the prior art invariably contains one common detractive denominator inherent within its design. Whatever else is intended—whether barbell, dumbbell, or one of the various exercise machines designed for total fitness—there exists some sort of handle which must be grasped in order to use the device. Quite clearly, one must hold onto a handle to make the device work. This action of holding the handle automatically and necessarily employs the conjunctive (adjoining) muscles. Such "helper" muscles actually take away from the isolation required for full development of any specifically targeted muscle.

This detractive denominator occurs because of the physiological structure of the human body. A precise interface of cardiovascular, neural-nervous system, respiratory, and muscular function is adequate to carry the average person through their normal daily activity. However, this interface is simply not sufficient to create an above average (or dynamic) physique. Combined with the time constraints that typically discourage regular exercise, the obvious result is a rather large population group composed of "ordinary" (somewhat less than splendidly developed) individuals.

In said U.S. Pat. No. 4,813,669, the inventors disclosed an exercising device which an individual can utilize and manipulate without the necessity of grasping. In this device, weights and fillers are disposed in a casing having a constant outer diameter (O.D.). The ratio of weights to fillers is varied for varying the weight of the device. The weight casing is housed in a housing which includes a pair of body portions that are joined together by a keying means. The keying means includes an arcuate rib which is formed on the peripheral edge of each of the body portions and which mates with one another when the body portions are bought together. Thereafter, the peripheral edges are glued, ultrasonically welded or otherwise integrally joined.

While successfully providing a device which may be manipulated without grasping, this device can be improved on by providing better and easier access to the weights, so that they may be changed or selectively varied, as desired. Additionally, it would be further advantageous to provide a weight means that eliminates a substantial portion of the weights and/or fillers which are needed and which are readily subject to being lost. Finally, it would be further advantageous to provide such a weight means that is not subject to shifting during the use thereof.

While a significantly improved exercise device has been disclosed, further improvements can be made by providing a more secure and comfortable cushion means for the hand in the device. This cushion means may be removable for cleaning and replacement. Additional improvements relate to the tongue and groove configuration to mate the housing portions and to providing covers for the cap screws.

Accordingly, it will be appreciated that there remains a need for an exercise device for strengthening a user's targeted muscle; wherein the device is capable of being utilized by the user, such that a forceful grip is not required by the user; and wherein the necessity for employing the user's conjunctive adjoining muscles is substantially reduced, thereby substantially reducing the tendency to detract from the development of the user's targeted muscle, wherein the body portions thereof are formed so as to be readily separable, so as to provide access to the weights disposed therein, wherein only one weight is utilized at a time without the need of fillers, which is not capable of shifting during use thereof, and wherein a comfortable removable rest for the user's hand is provided in the device.

SUMMARY OF THE INVENTION

Accordingly, it is an object of the present invention to provide an exercise device for strengthening a user's targeted muscle which is capable of being utilized by the user thereof, such that the necessity for employing the user's conjunctive adjoining muscles is substantially reduced, thereby substantially reducing the tendency to detract from the development of the user's targeted muscle.

While not limited thereto, it is another object of the present invention to provide such an exercise device for strengthening a user's targeted muscles, including the abdominal region and extending thereabove, such as the biceps, triceps, forearm, deltoids and the pectoral muscles.

It is yet another object of the present invention to isolate the development of a targeted muscle by substantially eliminating the normal requirement for using the adjoining conjunctive muscles, thereby substantially improving the development of the targeted muscle.

It is still yet another object of the present invention to provide such a weight training device which provides ready access to the weights disposed therein for selectively changing the weight of, and the resistance provided by, the device.

It is a yet further object of the present invention to provide such a weight training device, wherein one weight is utilized for each desired resistance, and that is not subject to any slippage, sliding or shifting movement whatsoever during the use thereof.

The devices of the present invention, by virtue of their unique configuration, virtually eliminate the assistance of conjunctive muscles during the performance of many regimen exercises.

It is a further object of the present invention to provide an insert in the exercise device for more secure and comfortable placement of the user's hand.

More specifically, the user is not required to grasp the device of the present invention. Rather, the device simply cradles the user's hand, and the device is so designed that the user's hand remains at all times in a comfortable and natural "at rest" position. The device of the present invention cannot be grasped by a handle, because there is no handle to grasp. As a result, there is an accelerated rate of achievement, and less time is spent on exercise while deriving full benefit.

In a preferred embodiment, a device of the present invention weighing ten (10) pounds, when properly employed, has a beneficial effect roughly equivalent to the employment of a conventional thirty-five (35) pound weight heretofore resorted to in the prior art.

It is a still further object of the present invention to provide a method of forming the exercise devices of the present invention.

In accordance with the teachings of the present invention, there is disclosed herein an exercise device that has a housing having a weight means disposed therein. The housing further has an opening formed therein substantially tangentially of the housing. The opening is bounded by a relatively-thin outer wall and an inner wall having respective convex and concave portions. The hand of the user may be inserted through the opening in the housing, such that the user's hand is disposed between the inner that at least the fingers of the user's and outer walls, such that at least the fingers of the user's hand rest substantially on the convex portion of the inner wall, and such that the heel of the user's hand rests substantially on the concave portion of the inner wall. In this manner, a forceful grip is not required by the user, and the necessity for employing the user's conjunctive adjoining muscles is substantially reduced, thereby substantially reducing the tendency to detract from the development of the user's targeted muscle. Finally, the weight means has a pair of opposite ends; and each of the opposite ends is joined to a respective diametrically opposed portion of the housing.

Preferably, the housing includes a pair of complementary housing portions. The housing portions have respective peripheral edges along which the housing portions mate. Each of the housing portions also have one of the diametrically opposed portions of the housing to which one of the respective opposite ends of the weight means is joined. Means is provided for securing each of the opposite ends of the weight means to a respective diametrically opposed portion of the housing. In this manner, the peripheral edges of the housing portions mate with one another, forming an integral housing.

It is further preferred that the peripheral edge of one of the housing portions has a tongue formed thereon. Also the peripheral edge of the other of the housing portions has a groove formed therein to receive the tongue in a mating relationship. In this manner, the peripheral edges of the housing portions mate with one another.

In a still further preferred embodiment, the means for securing each of the opposite ends of the weight means to a respective diametrically opposed portion of the housing includes a pair of cap screws. Each cap screw is removably disposed through a respective housing portion and received in a respective opposite end of the weight means. In this manner, the housing portions are removably secured to the respective opposite ends of the weight means, with the peripheral edges of the housing portions in a mating relationship. In this respect, it is further preferred for each of the opposite ends of the weight means to have a blind axial bore formed therein for receiving one of the respective cap screws therein.

In accordance with the further teachings of the present invention, there is disclosed a housing that includes complementary housing halves. Each of these housing halves is relatively thin-walled. The housing halves have respective peripheral edges that are mated together along a common midplane between the housing halves. A weight means is disposed within the housing. The weight means has a pair of opposite ends; and means are provided for securing each of the housing halves to a respective opposite end of the weight means. In this manner, the housing halves are secured to one another having the respective peripheral edges mated together along the common midplane. The housing has an opening formed therein substantially tangentially of the housing. In this manner, the hand of the user may be inserted through the opening in the housing and at least partially around the weight means radially thereof. The user's hand is further disposed at least partially between the weight means and the wall of the housing, such that a forceful grip is not required by the user, and such that the necessity for employing the user's conjunctive adjoining muscles is substantially reduced. Thus, the tendency to detract from the development of the user's targeted muscle is substantially reduced.

Viewed in another aspect, the present invention provides an exercise device including a housing having a pair of complementary mating portions formed with peripheral edges mating along a common midplane. A weight is disposed between the mating housing portions substantially transversely of the common midplane therebetween. Means are provided for securing the housing portions and the weight together to thereby form a unitary article. The housing has a substantially tangential opening formed therein to receive the user's hand, such that the palm of the user's hand substantially confronts and is cradled around the weight, and such that the back of the user's hand substantially confronts an inner walled surface of the housing. In this manner, a forceful grip by the user's hand on the weight is not necessary; and the necessity for employing the user's conjuctive adjoining muscles is substantially reduced, thereof substantially reducing the tendency to extract from the development of the user's targeted muscle.

Viewed in yet another aspect, the present invention provides an exercise device having an opening formed therein through which the hand of the user may be inserted. This opening is defined by a pair of walls in the device, including an inner wall and an outer wall, such that the user's hand is substantially curved around the inner wall and is disposed between the inner and outer walls, respectively. An internal wall within the device limits the insertion of the user's hand through the opening. A weight means is disposed substantially centrally of the device and within the inner wall thereof, such that a forceful grip of the user's hand on the weight means is not necessary, and such that the necessity for employing the user's conjunctive adjoining muscles is substantially reduced, thereby substantially reducing the tendency to detract from the development of the user's targeted muscle.

Preferably, the inner wall has a convex outer surface; the outer wall has a concave inner surface and is disposed radially of the inner wall; and the internal wall comprises a radial wall joining the inner and outer walls beyond the opening in the device.

In a preferred embodiment, the exercise device is substantially spherical, and the opening is formed therein substantially tangentially thereof.

It is also preferred that an insert be disposed in the opening between the inner wall and the outer wall and the user's hand be cushioned.

Viewed in a further aspect, the present invention provides an exercise device having an opening for receiving the user's hand, wherein when the user's hand is received in the exercise device, a forceful grip is not required during use of the device, thereby substantially avoiding use of the user's conjunctive adjoining muscles, and thereby substantially strengthening the user's targeted muscle. A weight means is provided within the exercise device. A cushioned insert is provided within the opening in the exercise device and substantially between the user's hand and the exercise device, whereby the insert contributes to the user's convenience and comfort during use of the exercise device.

Viewed in yet still another aspect of the present invention, a method is disclosed for forming an exercise device intended for strengthening a user's target muscle. This method includes the steps of forming a pair of substantially hemispherical, relatively thin-walled housing portions. At least one of the housing portions has a cut-away portion, and each of the housing portions has a peripheral edge and a diametrically-opposed portion. A weight means is provided having a pair of opposed ends, and a pair of cap screws are provided. Each opposed end of the weight means is secured to a respective diametrically-opposed portion of each of the housing portions by one of the respective cap screws. In this manner, each opposed end of the cylinder is supported thereby; and the peripheral edges mate with one another, whereby the housing further has an opening formed therein substantially tangentially of the housing and communicating with the cut-away portion thereof.

These and other objects of the present invention will become apparent from a reading of the following specification, taken in conjunction with the enclosed drawings.

BRIEF DESCRIPTION OF THE DRAWINGS

FIG. 12 is a side elevation of the body portion of the casing for the weight means, wherein the body portion is folded into a substantially flat shape for shipment.

FIG. 13 is an end view of the body portion of FIG. 12.

FIG. 14 is a side elevation of the body portion of the casing, wherein the body portion is unfolded into a substantially cylindrical shape for use thereof during manufacture of the exercise device.

FIG. 15 is an end view of the unfolded cylindrical body portion, corresponding substantially to FIG. 14.

FIG. 16 is a perspective view of the cylindrical body portion with a cap inserted on one end thereof and further with weights being disposed therein.

FIG. 17 is a further perspective view of the cylindrical body portion having all the weights disposed therein, further showing the insertion of a cap on the other end thereof.

FIG. 18 is a perspective view of the cylindrical weight means being disposed in the respective concave inner recess of one of the hemispherical housing portions.

FIG. 19 is another perspective view of the other of the hemispherical housing portions, shown partially disposed over the other of the opposed ends of the cylindrical weight means.

FIG. 20 is still another perspective view, showing the hemispherical housing portions being assembled and almost completely covering the cylindrical weight means.

DESCRIPTION OF PREFERRED EMBODIMENTS

Figure 1:
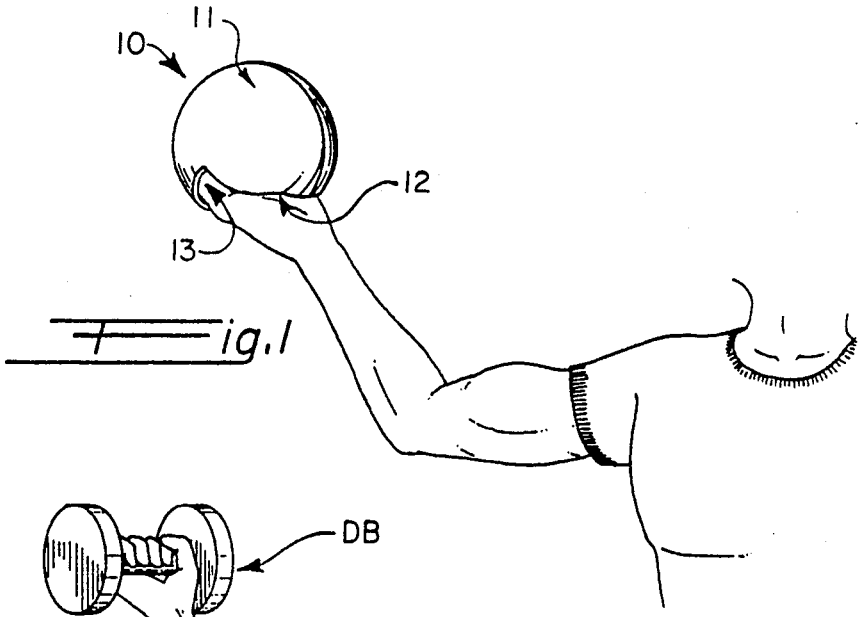
FIG. 1 is a pictorial view of the exercise device of the present invention, illustrating one use of the device for strengthening the user's targeted muscle which, in this case, is the bicep.

With reference to FIG. 1, there is illustrated the exercise device 10 of the present invention for strengthening one of the user's targeted muscles (in this case, the bicep) such that a forceful grip is not required by the user. Such an arrangement substantially eliminates the necessity for employing the user's conjunctive muscles adjoining the bicep. In this manner, the tendency to detract from the development of the user's targeted bicep muscle is substantially reduced.

Figure 1A:
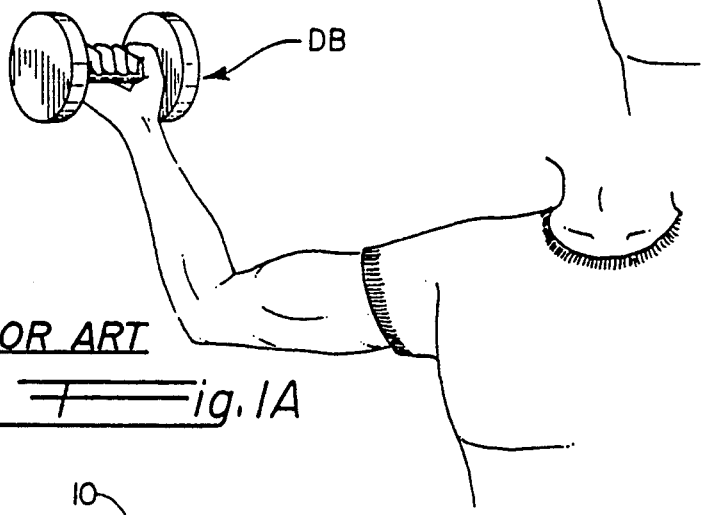
PRIOR ART Fig. 1A
FIG. 1A is a pictorial view of a conventional prior art dumbbell, illustrating its normal use.

By comparison, and with reference to FIG. 1A, there is illustrated the use of a conventional dumbbell DB for strengthening the user's targeted muscle (again, in this case, the bicep). In using these conventional devices, such as a dumbbell, the user must forcefully grip the handle of the dumbbell. This gripping action has the tendency to detract from the development of the user's targeted bicep muscle, thereby substantially reducing the efficiency of the device.

The same concept is equally applicable to other targeted muscles, besides the bicep, consonant with the teachings of the present invention.

Figure 2:
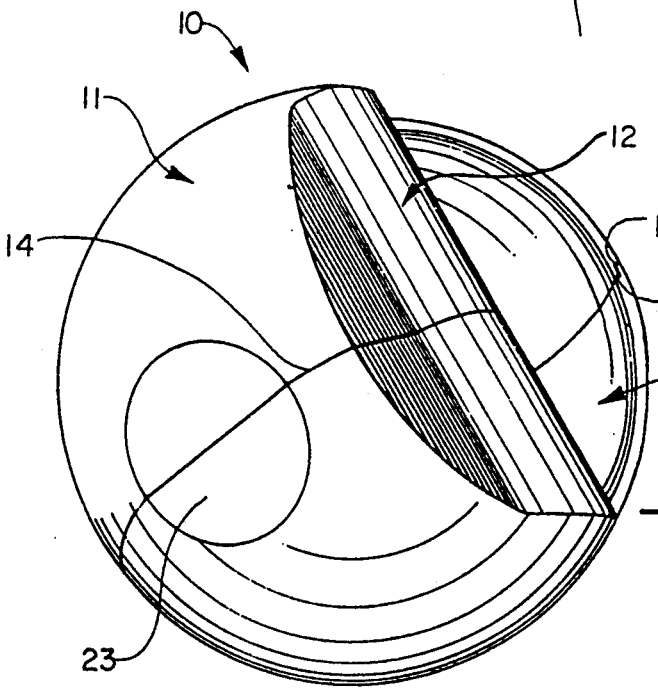
FIG. 2 is a perspective view of a preferred embodiment of the exercise device of the present invention.
Figure 3:
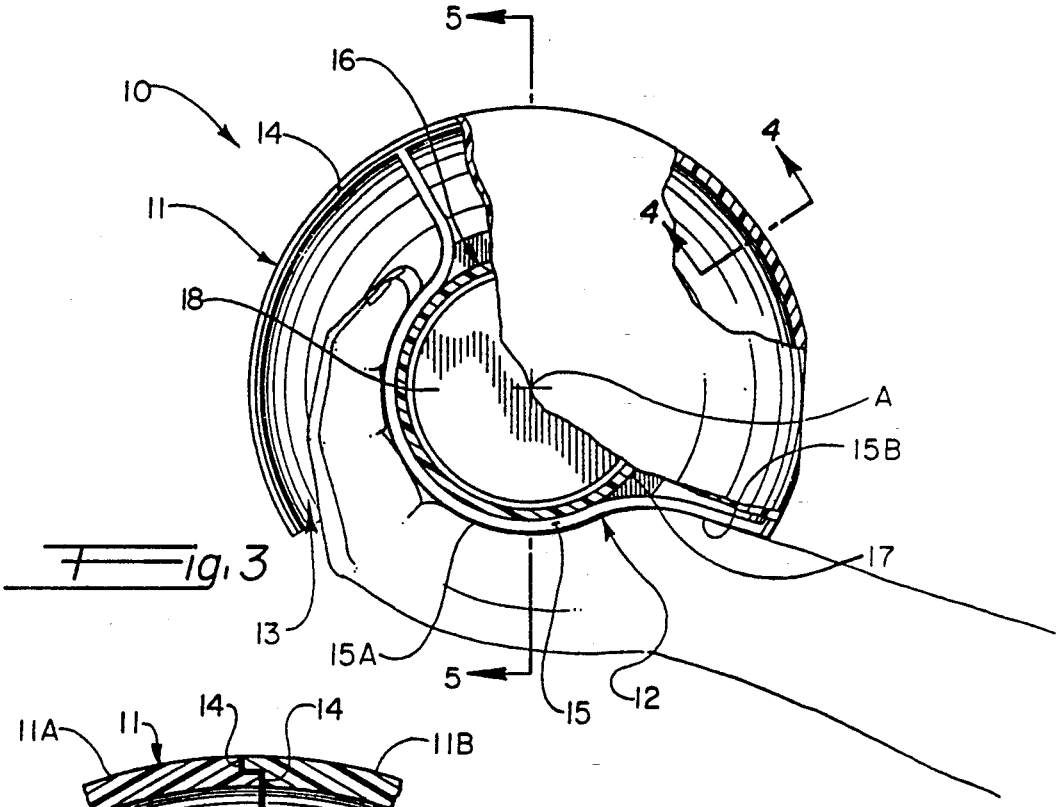
FIG. 3 is a side elevational view of the exercise device, with parts thereof broken away and sectioned, to show the positioning of the user's hand therein between the relatively thin-walled housing and the cylindrical weight means mounted in the housing.
Figure 4:
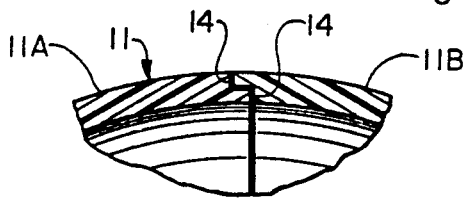
FIG. 4 is a section view, taken along lines 4—4 of FIG. 3 and drawn to an enlarged scale, and showing the arcuate ribs between the complementary relatively thin-walled hemispherical housing portions.
Figure 5:
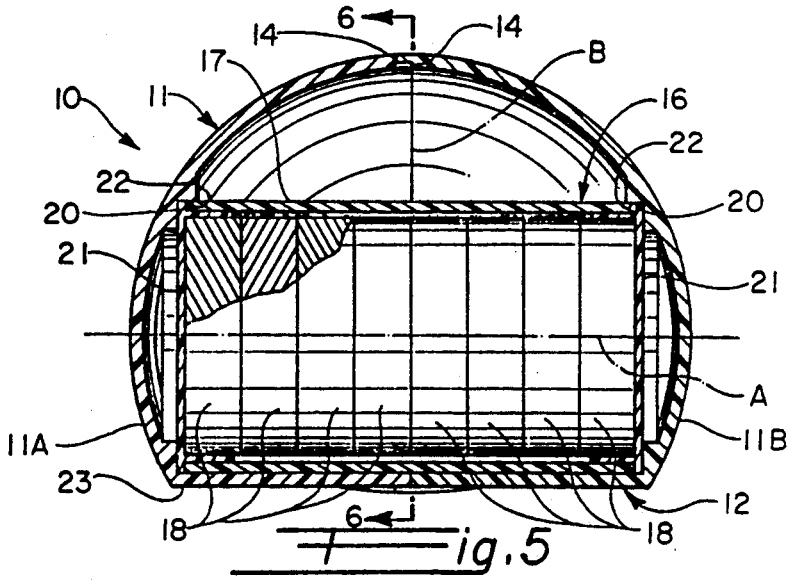
FIG. 5 is a section view, taken along lines 5—5 of FIG. 2, and showing the manner in which the cylindrical weight means is mounted between the complementary housing portions.
Figure 7:
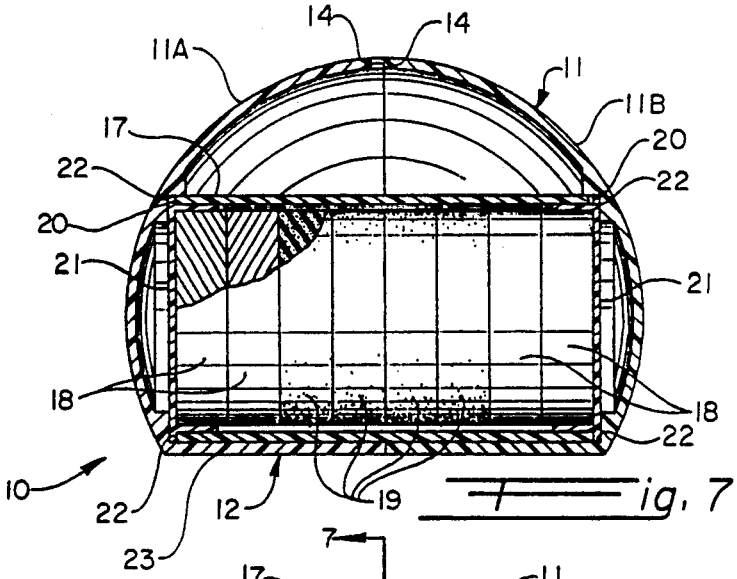
FIG. 7 is another section view, corresponding substantially to FIG. 5, but showing several "filler" or "dummy" weights disposed in the cylinder.
Figure 6:
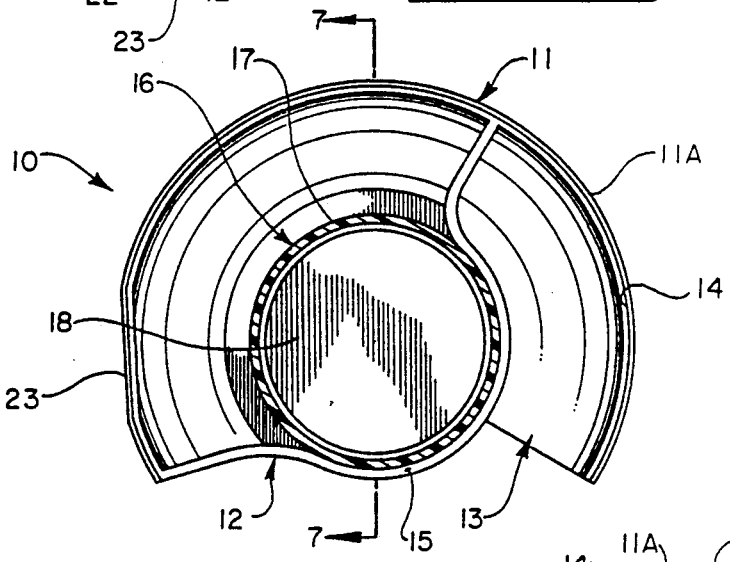
FIG. 6 is a section view, taken along lines 6—6 of FIG. 5.
Figure 8:
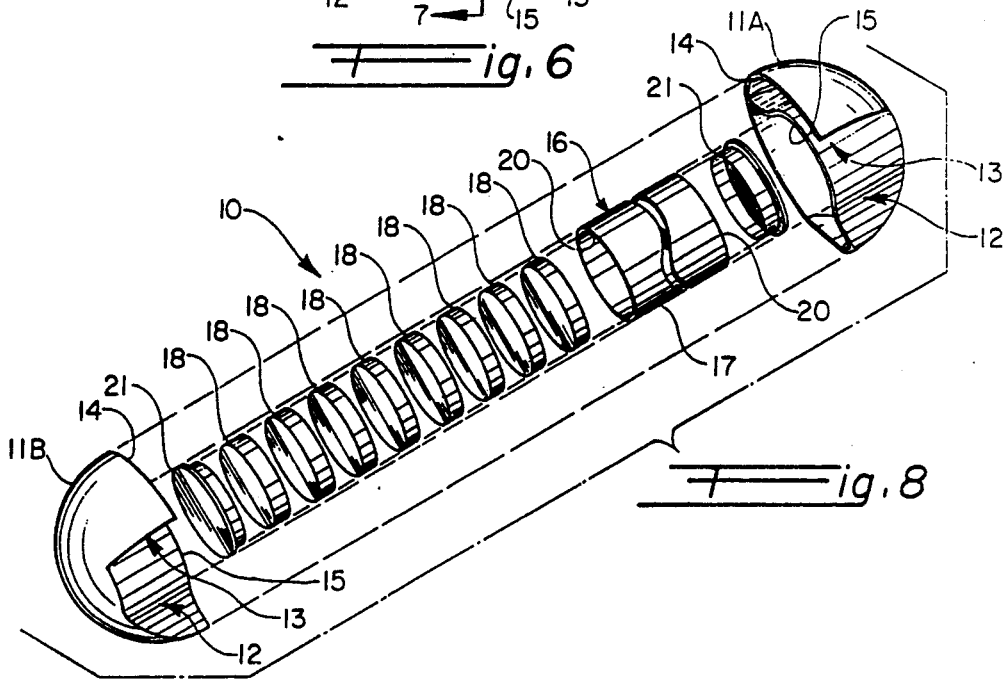
FIG. 8 is an exploded perspective view of the exercise device of FIG. 5.

With reference to FIGS. 2–4, the exercise device 10 includes a substantially-spherical relatively thin-walled housing 11 having a diametral axis designated at A. The housing 11 includes a pair of housing portions 11A and 11B joining at a common midplane B. Each of the housing portions 11A and 11B is preferably substantially hemispherical and identical to one another; moreover, the housing halves 11A and 11B are molded from a suitable plastic material, such as a polycarbonate having relatively high impact strength. However, it will be expressly understood and appreciated by those skilled in the art that the present invention is not so limited.

With this in mind, the housing 11 has a cut-away portion 12 formed therein. The housing further has an opening 13 formed therein substantially tangentially of the housing 11 and communicating with the cut-away portion 12. Through this opening 13, and as shown more clearly in FIG. 3, the hand of the user may be inserted into the housing 11 for use of the exercise device 10.

The housing 11 includes a suitable keying means between the pair of hemispherical portions 11A and 11B, whereby the hemispherical portions are retained together and form the substantially spherical housing 11. Preferably, and as shown more clearly in FIG. 4, this keying means includes an arcuate rib 14 formed on the peripheral edges of each of the housing portions 11A and 11B. These ribs 14 are complementary and are mated when the housing portions 11A and 11B are brought together to form the spherical housing 11. Thereafter, the edges of the housing portions 11A and 11B are glued, ultrasonically welded, or otherwise integrally joined with one another.

Each of the thin-walled housing portions 11A and 11B has a concave inner walled portion 15 forming a circular recess (for purposes hereinafter described).

With further reference to FIGS. 5–8, the weight means comprises a casing 16 disposed within the housing 11 and, preferably, substantially coincident with the diametral axis A of the housing 11 and at right angles to the common midplane B between the housing portions 11A and 11B. The casing 16 has a body portion 17, within which disc-shaped weights 18 and/or "dummy" weights or "fillers" 19 are disposed. Preferably, the casing 16 is substantially cylindrical in shape. However, it is to be understood that any suitable shape of the casing 16 may be employed (and other types of ballast may be employed other than the fillers 19) consonant with the teachings of the present invention. The body portion 17 of the casing 16 further has a pair of opposed ends 20, each of which is preferably open.

A cap 21 is disposed over each open end 20 of the casing 16. The caps 21 aid in retaining the selected weights 18 and/or "fillers" 19 within the casing 16. If desired, the caps 21 may be omitted entirely, with either (or both) opposed end portions 20 being integrally sealed with a respective end wall, or with both ends 20 being left open.

Disposed in the casing 16 is the selected weights 18 and/or "fillers" 19 which are desired to be lifted by the targeted muscle. It is preferred that each weight 18 be shaped substantially coincident with the shape of the interior of the casing 16, and particularly the body portion 17 thereof. If, as in the preferred embodiment, the casing is substantially cylindrical in shape, then each weight 18 and/or "filler" 19, is preferably substantially disc-shaped in appearance and is sized to be received within the body portion 17 of the casing 16. The weights 18 may be fabricated from lead, steel, sand enclosed in plastic, or any other suitable material.

The "dummy" weights or "fillers" 19 may be utilized in place of any one or several of the weights 18. Such "fillers" 19 are preferably fabricated from a foam plastic (or other suitable) material having substantially identical geometric proportions as the weights 18 themselves. By substituting any one or several "fillers" 19 for the "real" weights 18, the weight of the device 10 being lifted by the targeted muscle (the bicep, for example) may vary from substantially zero (wherein all "fillers" 19 and no weights 18 are utilized) to a maximum value (wherein all weights 18 and no "fillers" 19 are utilized).

It is to be understood that any suitable weight or weights may be employed consonant with the teachings of the present invention. In a preferred embodiment, each of the weights 18 weighs 1.25 pounds. If the casing 16 is sized so as to receive eight (8) such 1.25 pound weights 18 therein, then no "fillers" 19 are employed, and basically, a ten (10) pound weight is obtained for the exercise device; and if only four (4) of the weights 18 are employed, then basically, a five (5) pound weight is obtained, in which case four (4) fillers 19 are employed as shown more clearly in FIG. 7. In a preferred embodiment, the complementary hemispherical housing halves 11A and 11B, together, weigh ten ounces (10 oz.) and, if desired, this weight may be taken into account in determining the weight of the overall exercise device 10. Moreover, if desired, a heavier weight may be chosen for the housing halves 11A and 11B.

While it is not necessary that such "fillers" 19 be utilized, the use of such "fillers" 19 aids in filling the interior of the casing 16, thereby preventing the weights 18 disposed therein from shifting during the use thereof. If such inner wall and is disposed within "fillers" 19 were not provided, then the weights 18 disposed therein may be subject to lateral movements (or "shifting") within the casing 16 during use of the device 10.

As noted herein, each of the hemispherical housing portions 11A and 11B of the relatively thin-walled housing 11 is provided with a concave inner walled portion 15. Each of these concave inner portions 15 receives and supports a respective opposed end 20 of the casing 16 therein, when the hemispherical housing portions 11A and 11B are joined to one another. Preferably, each of the opposed ends 20 is further supported on a respective internal annular shoulder 22 formed in each of the concave inner portions 15.

With reference again to FIG. 3, during use of the exercise device 10 of the present invention to strengthen the user's bicep (for example), the hand of the user is inserted through the opening 13 in the housing 11 and at least partially around the casing 16 radially thereof. In this manner, the user's hand is "cradled" in the hollow spherical housing 11, being at least partially disposed between the casing 16 and the relatively-thin wall of the housing 11. The palm of the user's hand is supported substantially against the convexly-formed inner walled portion 15A, such that the heel of the user's hand is supported substantially on the concave section 15B of the inner walled portion 15.

When utilized in this fashion, the user's hand at all times remains in a comfortable, natural "at rest" position. In such a manner, a forceful grip by the user is not required throughout the full range of motion of the exercise device 10, such that the necessity for employing the user's muscles which adjoin the bicep (the conjunctive muscles) is substantially reduced. As a result, the device 10 substantially reduces the tendency to detract from the development of the user's targeted muscle (in this case, for example, the bicep).

Figure 9:
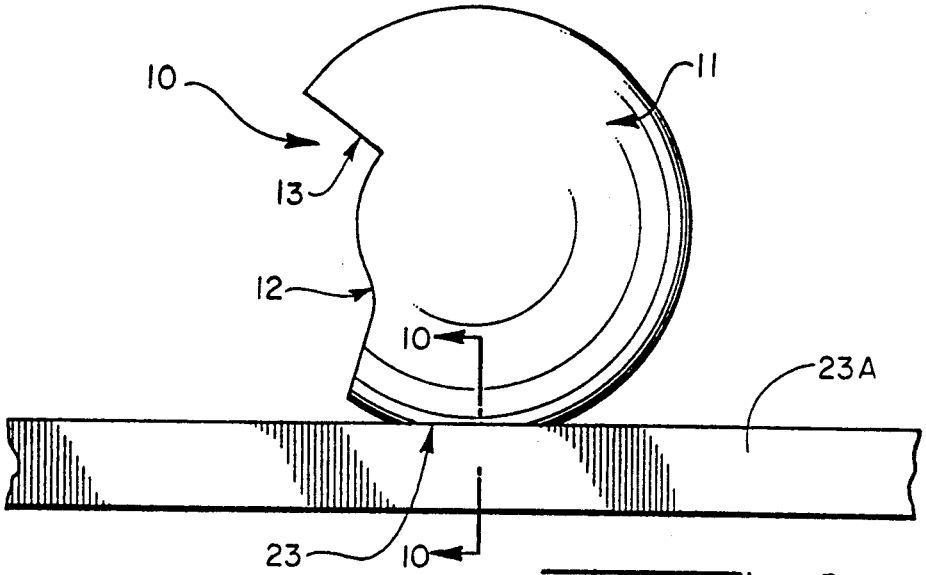
FIG. 9 shows the positioning of the exercise device of the present invention upon a table (or other surface) so that the exercise device will not roll off the table.
Figure 10:
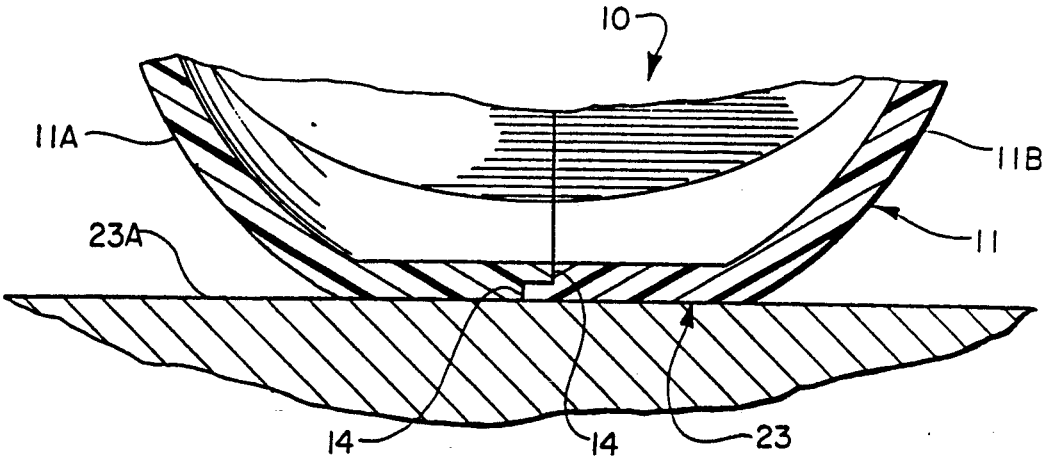
FIG. 10 is a section view thereof, taken along lines 10—10 of FIG. 9, and drawn to an enlarged scale.

With reference to FIGS. 9 and 10, the outer surface of the housing 11 may, if desired, be truncated to form a flat surface 23 thereon. Provision of this flat surface 23 aids in preventing the device from rolling when the exercise device 10 is placed on a substantially flat surface, such as a table 23A as illustrated in FIGS. 9 and 10.

Figure 11:
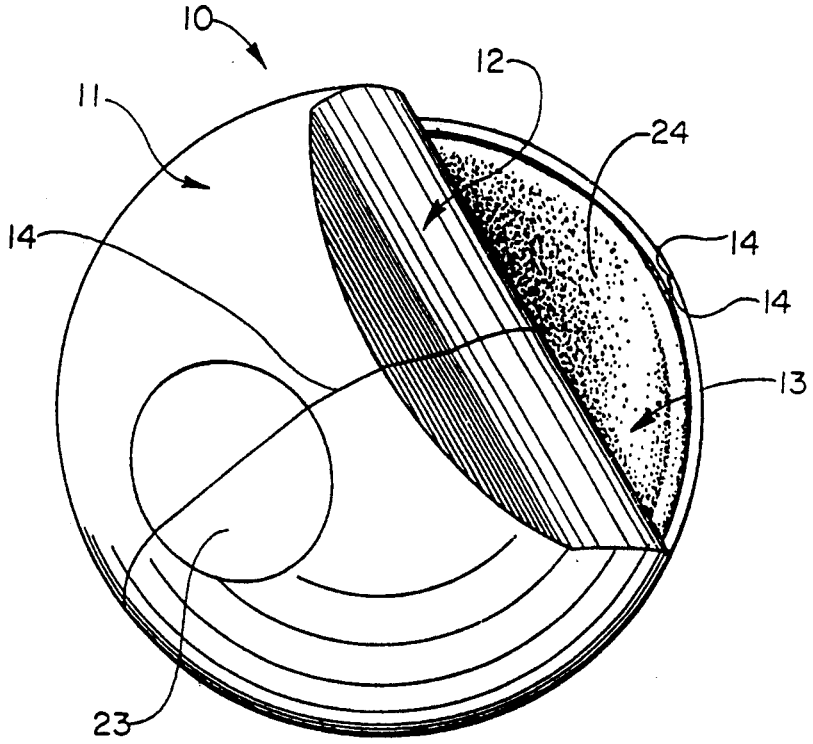
FIG. 11 is another perspective view of the exercise device of the present invention, showing the padding disposed within the housing for providing a cushion for the hand of the user during use of the device.
Figure 12:
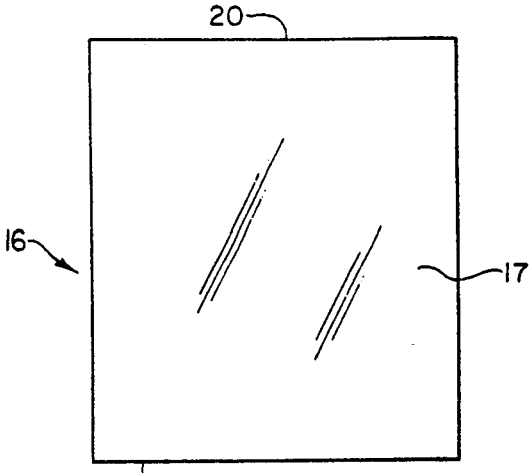
FIGS. 12–20 are sequence views, illustrating the method for forming and assembling a preferred embodiment of the exercise device of the present invention.
Figure 14:
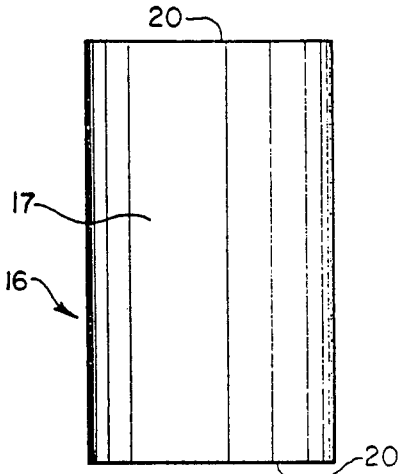
Figure 13:
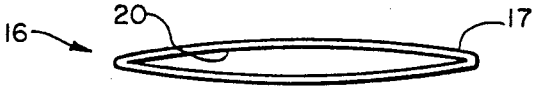
Figure 15:
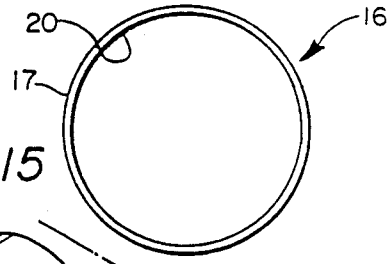

With reference to FIG. 11, in a preferred embodiment of the exercise device 10, a padding 24 (or other suitable means) may be disposed within the housing 11 and between the casing 16 and the housing 11. In this manner, a cushion is provided for the hand of the user which is disposed in the exercise device 10 during use thereof. Additional padding may be disposed within the housing 11, opposite to the padding 24, if desired. Further details of an embodiment having a cushion for the hand of the user are described in detail below and in FIGS. 41–50.

With reference to FIGS. 12–20, there is illustrated the sequence of steps comprising the preferred method for assembling and forming the exercise device 10 of the present invention.

Preferably, each of the hemispherical housing portions 11A and IIB is molded from a relatively high-impact strength polycarbonate or other plastic or suitable material; and, as previously described, the hemispherical housing portions 11A and 11B are formed as mirror images of each other. If desired, the casing 16 may be molded as a sleeve or tubing or else extruded; but in the preferred embodiment, the body portion 17 of the casing 16 comprises a flexible plastic sleeve which is folded flat for shipment (as shown more clearly in FIGS. 12 and 13) and then is unfolded (as shows more clearly in FIGS. 14 and 15) into a substantially cylindrical shape for use in the fabrication and assembly of the overall exercise device 10. The cylindrical body portion 17 is sold under the trademark "JETRAN" by SLM Manufacturing Corp. (of Somerset, N.J.). Caps 21 are formed for each respective open end of the cylindrical body portion 17.

Figure 16:
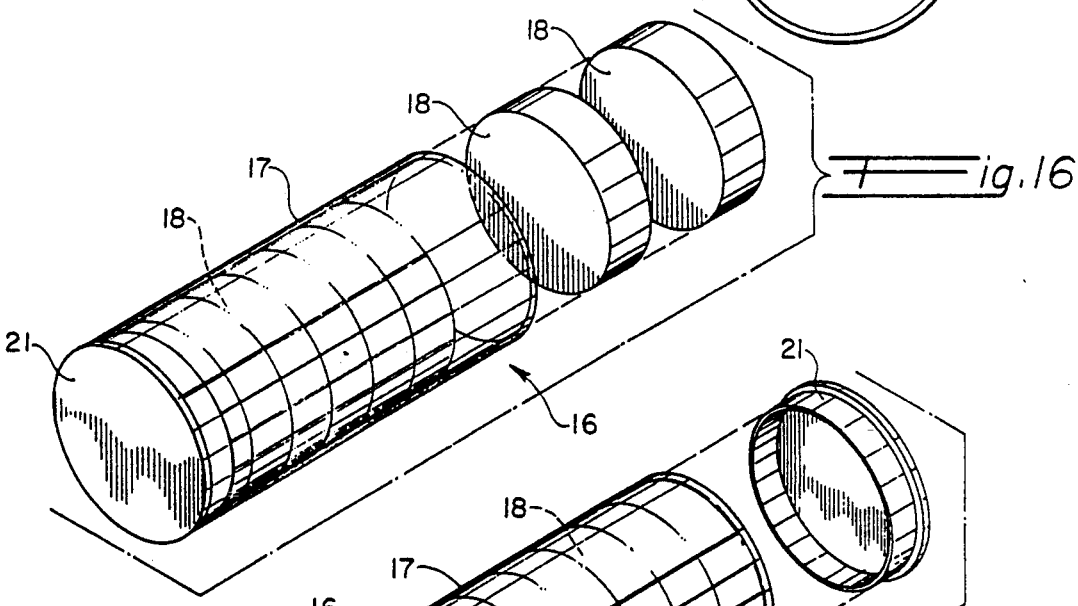
Figure 17:
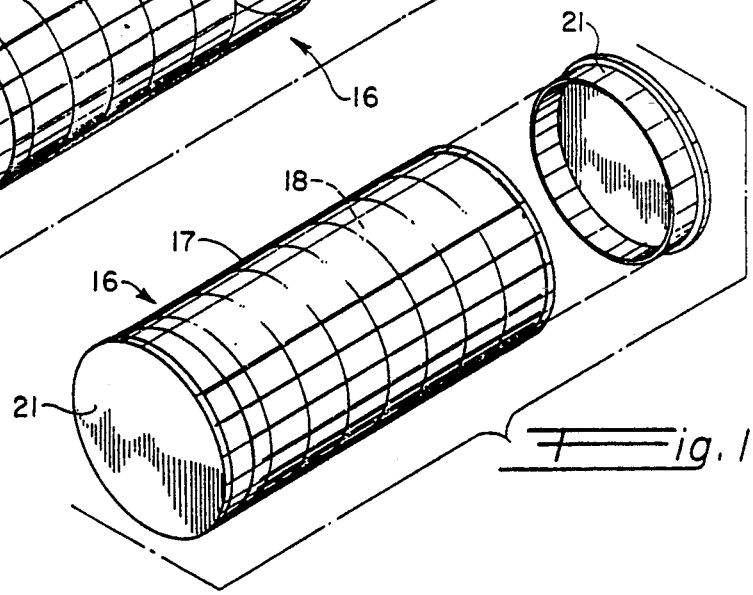

Referring to FIGS. 16 and 17, the cylindrical body portion 17 of the casing 16 has a cap 21 disposed on one of the open opposed ends 20 thereof. The desired weights 18 and/or "fillers" 19 are then received within the cylindrical body 17. The other cap 21 is then disposed on the other of the open opposed end portions 20 of the cylindrical body 17, whereby the weights 18 and/or "fillers" 19 are retained in the cylinder. If desired, these caps 21 may be either removably disposed over each respective end portion 20, whereby the weights 18 and/or "fillers" 19 are removably retained therein, or the caps 21 may be disposed over each respective end portion 20 and integrally secured in place therein, so that the weights 18 and/or "fillers" 19 are permanently retained therein. It is to be noted that the caps 21 may be disposed over each of the end portions 20 in the order described above or a cap 21 may be placed over each respective end portion 20 after the desired weight 18 and/or "fillers" 19 have been disposed in the cylinder 17.

Figure 18:
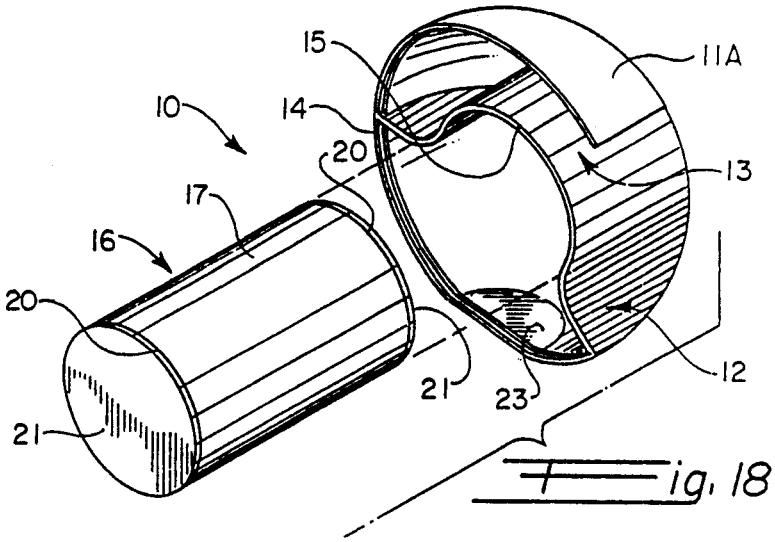
Figure 19:
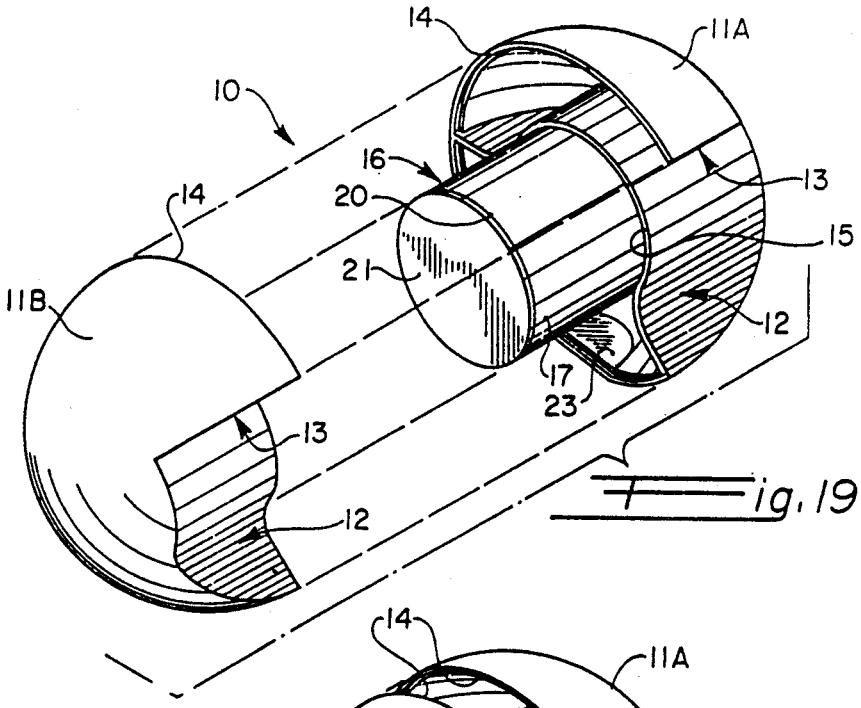
Figure 20:
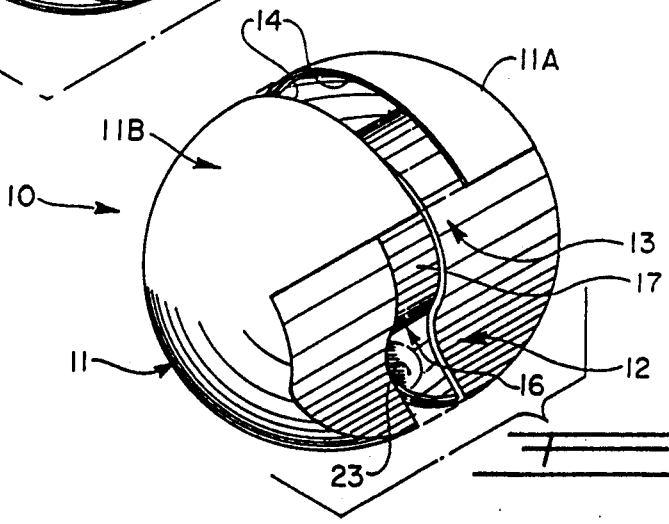

Referring to FIGS. 18–20, the assembled cylindrical casing 16 with the weights 18 and/or fillers 19 therein then has one of the opposed ends 20 inserted into a respective concave inner portion 15 of one of the hemispherical housing portions 11A as shown more clearly in FIG. 18. There, the opposed end 20 is received on and abuts the internal annular shoulder 22, wherein the opposed end 20 of the cylindrical casing 16 is supported. Then the other of the opposed ends 20 is inserted into the other respective concave inner portion 15 of the other hemispherical housing portion 11B (as shown more clearly in FIGS. 19 and 20). There, the other opposed end 20 is received on and abuts the internal annular shoulder 22 therein, wherein the other opposed end 20 of the cylindrical casing 20 is supported. The respective hemispherical housing portions 11A and 11B are then aligned with one another and brought together, as shown in FIG. 20, such that the arcuate ribbed edges 14 of the hemispherical housing portions 11A and 11B contact one another. The housing portions 11A and 11B are integrally joined together by a suitable adhesive, sonic or ultrasonic welding, or other suitable means. In this manner, a substantially spherical housing 11 having a single diametral axis and a single cut-away portion 12 is formed. The housing 11 further has a single opening 13 formed therein, substantially tangentially of the housing 11 and in communication with the cut-away portion 12 thereof for the hand of the user to be inserted during use, as herein described. If desired, the housing 11 could have a built-in cylindrical casing formed therein to receive the weights 18, etc., in which case a separate cylinder 17 would not be necessary.

Figure 21:
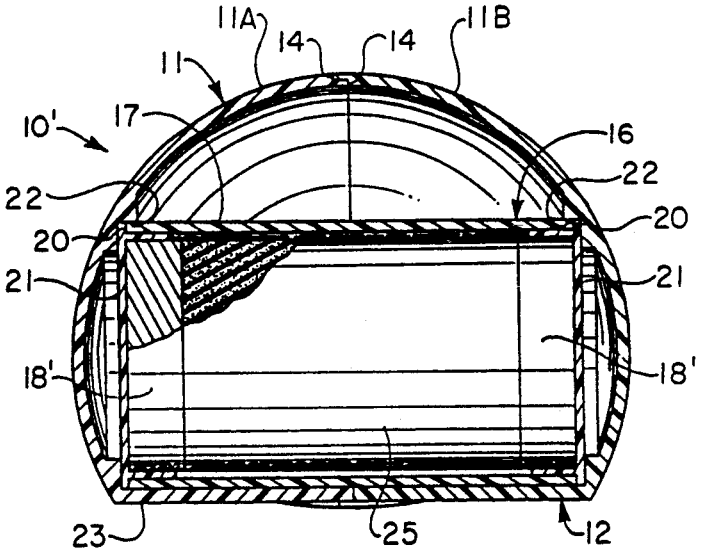
FIG. 21 is a longitudinal section of a second embodiment of the present invention, corresponding substantially to that of FIG. 5, but showing a pair of circular discs separated by a dowel rod to form the cylindrical weight means within the housing.
Figure 22:
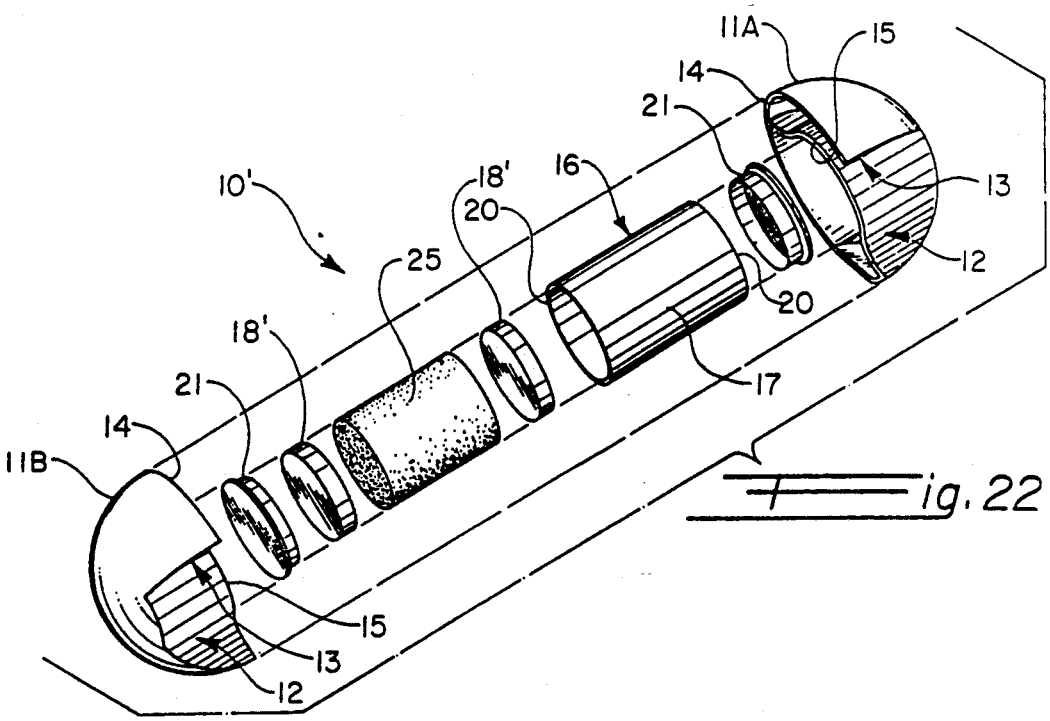
FIG. 22 is an exploded perspective view thereof.

With reference to FIGS. 21 and 22, constituting a first alternate embodiment 10' of the present invention, a pair of disc-shaped weights 18' are separated by a cylindrical "dummy" block or dowel rod 25. The outer diameter ("O.D.") of the weights 18' and the dowel rod 25 remain substantially constant; however, the thickness of the disc-shaped weights 18' (and the length of the cylindrical dowel rod 25) may be changed to provide a heavier (or lighter) weight for the exercise device 10'. This accommodates a range of exercise devices of different weights, thus facilitating an entire product line using the same housing members 11A and 11B. Like the other embodiments of the present invention, this achieves market expansion and penetration consonant with manufacturing standardization.

Figure 23:
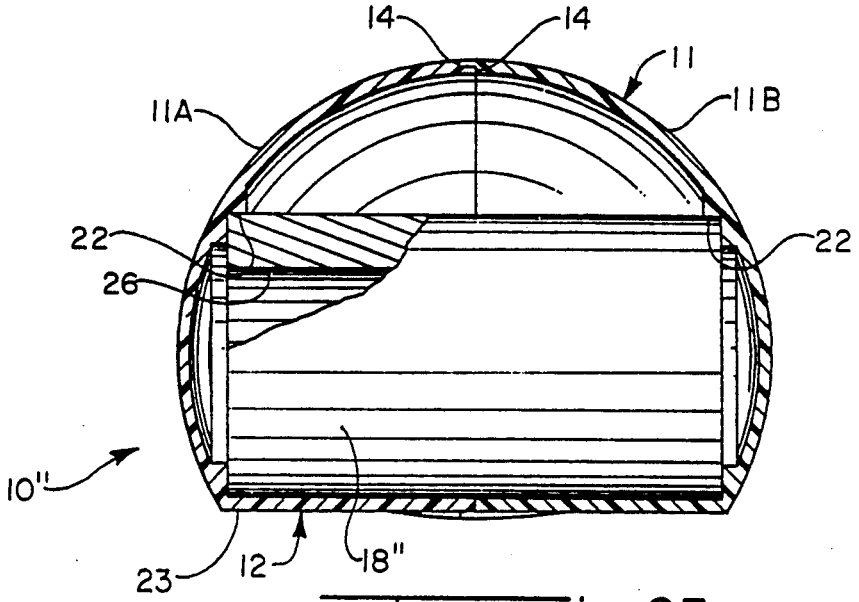
FIG. 23 is a longitudinal section of a third embodiment of the present invention, corresponding substantially to that of FIG. 5, but showing a weighted sleeve to form the cylindrical weight means within the housing.
Figure 24:
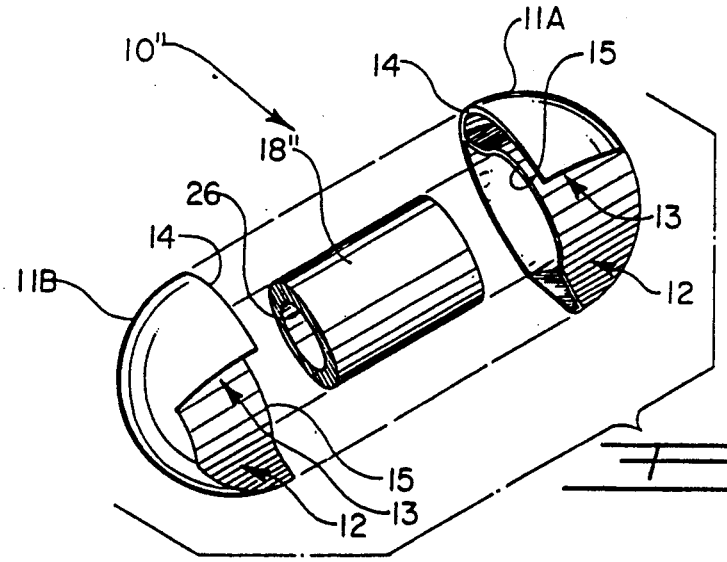
FIG. 24 is an exploded perspective view thereof.

With reference to FIGS. 23 and 24, constituting a second alternate embodiment 10 of the present invention, a weight 18 comprising a single cylindrical sleeve is disposed between the respective housing portions 11A and 11B. The cylindrical weight 18" has a central bore 26 formed therein. Thus, the cylindrical weight 18" has a substantially constant length; but the bore 26 may have a variable diameter, thereby changing the effective weight thereof for accommodating a desirable product line of exercise devices 10.

Figure 25:
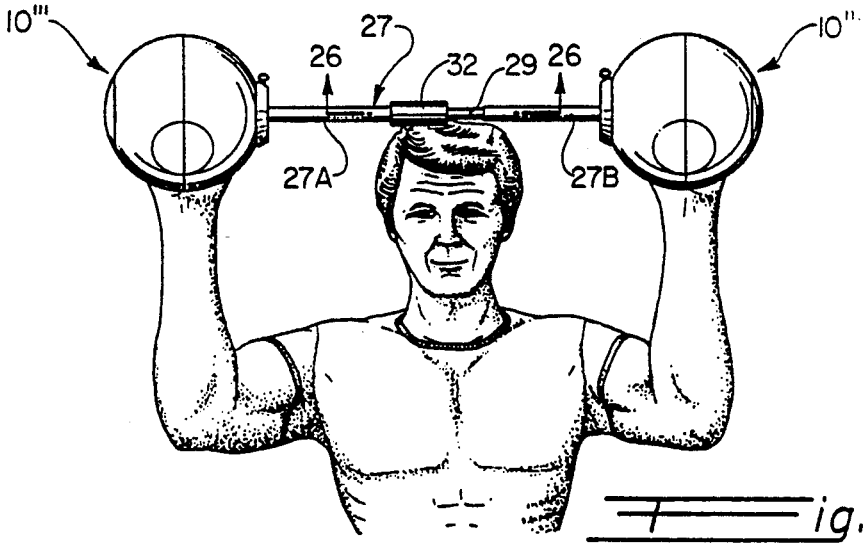
FIG. 25 illustrates how two of the exercise devices of the present invention may be used in combination with a telescoping bar therebetween to form an improved exercise device, the use of which is somewhat similar to that of a conventional barbell.
Figure 26:
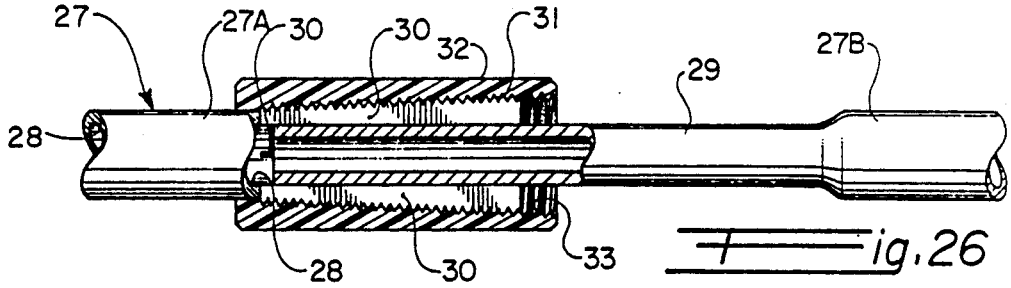
FIG. 26 is a section view (with parts thereof in elevation) taken along the lines 26—26 of FIG. 25, drawn to an enlarged scale, and showing the telescoping members of the bar.
Figure 27:
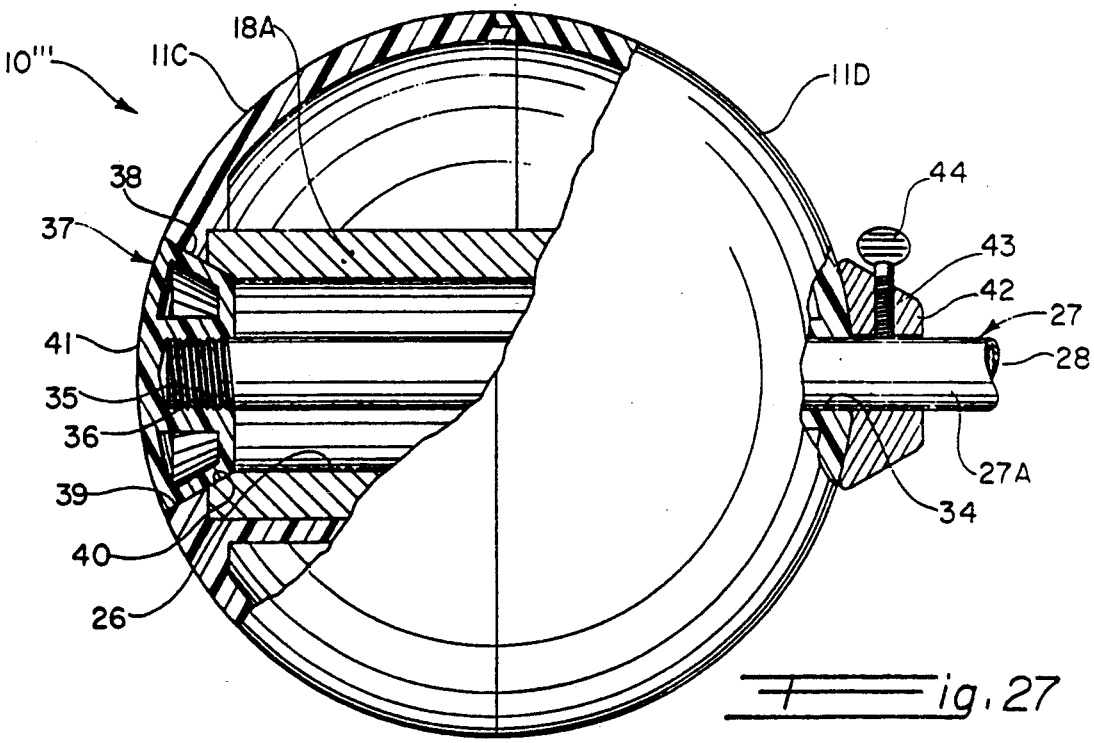
FIG. 27 is a further section view, taken along the lines 27—27 of FIG. 25, drawn to an enlarged scale, and showing the coupling of one of the exercise devices of the present invention to the telescoping bar.

With reference to FIGS. 25–27, a pair of exercise devices of the present invention may be suitably coupled together to form a barbell type of device.

More specifically, an exercise device 10 is carried on the respective ends of a bar 27. The bar 27 includes telescoping bar members 27A and 27B. Bar member 27A is preferably tubular and has an axial bore 28 to receive a reduced-diameter portion 29 of bar member 27B, as shown more clearly in FIG. 26. Bar member 27A has four circumferentially-spaced slots 30 formed therein, and the outer diameter of bar member 27A is provided with external threads 31 radially of the slots 30. The reduced-diameter portion 29 of bar member 27B is slidably received in the axial bore formed in the tubular bar member 27A to the desired depth to adjust the length of the bar 27 to suit the convenience of the individual user. A clamping collar 32 is slidably carried by the bar member 27A and has an internal taper which is complementary to the external taper on the bar member 27A. The clamping collar 32 has internal threads 33 which engage the external threads 31 on the bar member 27A and exert a radially inwardly-directed pressure on the respective portions of bar member 27A intermediately of the circumferentially-spaced slots 30 formed thereon, thereby securely clamping the bar member 27A to the reduced-diameter portion 29 of the bar member 27B, and thereby retaining the bar 27 in its desired adjusted length. However, it will be appreciated by those skilled in the art that other means for adjusting the length of the bar 27 may be employed consonant with the teachings of the present invention.

With further reference to FIG. 27, the exercise device 10 includes housing halves 11C and 11D integrally joined together at their peripheral ribbed edges 14, respectively, and exercise device 10 carries a sleeve weight 18A having a bore 26. Housing half 11D has an opening 34 to receive the bar member 27A, which is telescopically received concentrically within the sleeve weight 18A. The end of bar member 27A is threaded, as at 35, to cooperate with the internally-threaded boss 36 of a clamping disc 37. Clamping disc 37 has a conical or tapered side surface 38 which wedges within a complementary internally-tapered or conical opening 39 formed in housing half 11C. The tapered surface 38 of clamping disc 37 also wedges against an annular chamfered surface 40 formed on the sleeve weight 18A, thereby securely retaining the weight 18A within the housing halves 11C and 11D. The outer surface 41 of clamping disc 37 is formed as a portion of a sphere (as shown more clearly in FIG. 27) so that in the overall assembly, the outer surface 41 of clamping disc 37 forms a smooth continuation of the spherical contours of the exercise device 10 and, more particularly, its housing half 11C. The bar member 27A also carries a slidable locking collar 42 provided with a set screw 43 having a thumb-actuated portion 44, thereby retaining the exercise device 10 on the bar member 27A. Bar member 27B has a similar connection with exercise device 10. With this arrangement, the exercise devices may be quickly and conveniently removed from the bar 27 and replaced with exercise devices having different weights, as desired, so that the full range of the dual exercise devices is facilitated.

With reference to FIGS. 28-35, the wide-ranging utility and application of the present to the accelerated development of various targeted muscles of the user, besides the bicep illustrated in FIG. 1, will be more readily appreciated. In FIGS. 28-35, the full lines illustrate the natural "at rest" positions, while the broken lines illustrate the stressed positions during use of the exercise device of the present invention. Moreover, it will be appreciated by those skilled in the art that the respective representations of FIGS. 28-35 are illustrative of the present invention and not limiting thereof.

Figure 28:
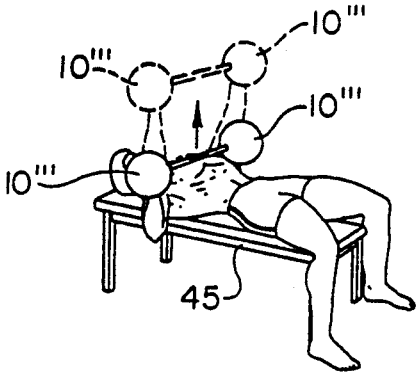
FIGS. 28-35 schematically illustrate various examples for use of the exercise devices of the present invention for the development and improvement of respective targeted muscles.
Figure 29:
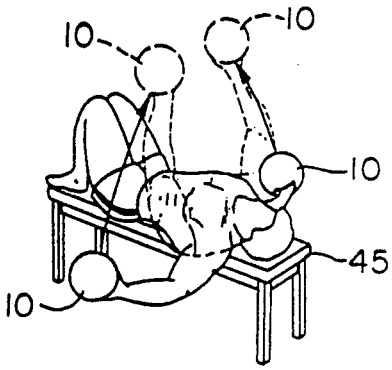
Figure 30:
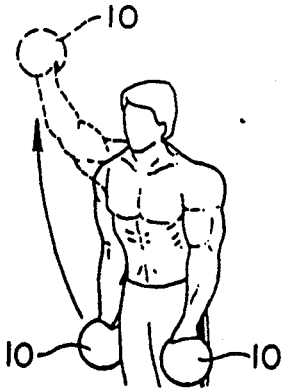
Figure 31:
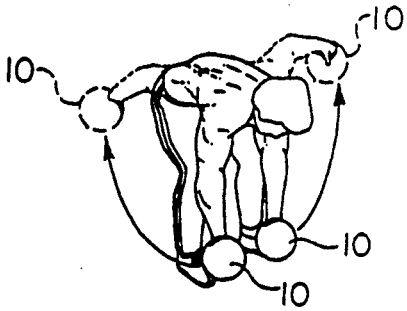
Figure 32:
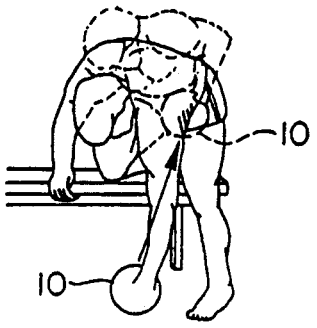
Figure 33:
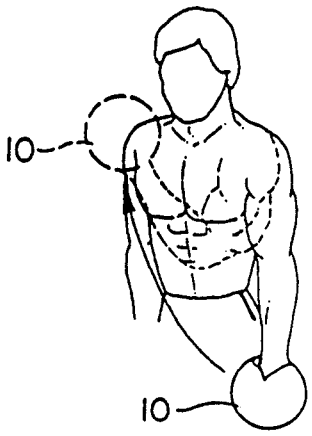
Figure 34:
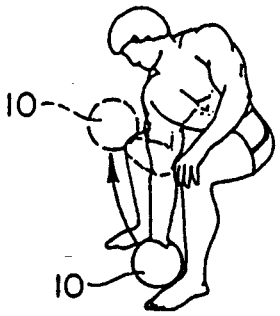
Figure 35:
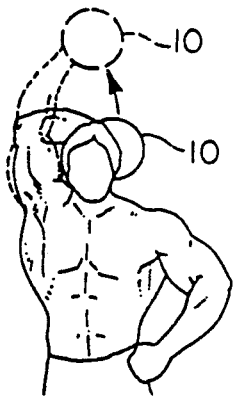

With this in mind, FIG. 28 and 29 illustrate the use of the exercise devices of the present invention for primarily developing and strengthening the chest muscles, as the user lies on a bench 45. FIGS. 30 and 31 illustrate the use of the exercise devices for primarily strengthening the shoulder muscles; FIG. 32 for the back muscles; and FIGS. 33-35 are for the arm muscles. FIG. 30 is a front deltoid raise. FIG. 31 is a bent-over lateral raise; FIG. 32 is a one-arm latissimus row; FIG. 33 is an alternate bicep curl; FIG. 34 is a bicep concentration curl; and FIG. 35 is a tricep extension.

In each case, the user's specific targeted muscle is being developed and strengthened. Since it is not required to exert a firm grip or grasp on the improved exercise devices of the present invention, the use of the adjoining or conjunctive muscles is at least substantially reduced, if not eliminated altogether. Thus, a smaller overall weight may be employed in the exercise devices, yet the beneficial effect will be substantially magnified; and, in a preferred embodiment, the improved exercise devices of the present invention have a beneficial effect which is substantially equal to a conventional weight of approximately 3.5 times the weight of the exercise device of the present invention. Viewed in another aspect, it will be appreciated that with the same exercise time period, the beneficial effect of the exercise devices of the present invention will be substantially enhanced over the use of the conventional devices of the prior art; or, conversely, a substantially reduced exercise time period may be employed to achieve approximately the same beneficial effect normally obtained by using a conventional device over a substantially larger exercise time period.

Moreover, with the same basic design, it is possible to manufacture and market a wide range of exercise devices of various respective weights. Thus, an entire product line has been facilitated for rapid development and market expansion and penetration, yet consonant with manufacturing standardization and relatively low-cost volume production methods.

Obviously, many modifications may be made without departing from the basic spirit of the above invention. For example, the cylindrical casing 16 may be dispensed with (if desired) and complementary cylindrical casings could be integrally molded within the hemispherical housing portions 11A and 11B, such that the desired weights 18 (and/or fillers 19) may be received directly therein. Additionally, the housings for the exercise devices of the present invention may be made of a relatively soft or pliable material, thereby customizing the exercise devices for use by children or handicapped persons going through physical therapy. Indeed, it is even feasible, consonant with the teachings of the present invention, to integrally cast or otherwise suitably form the exercise devices of a substantially solid material (with or without an internal ballast) yet having the same tangential opening and convexo-concave inner wall or surface to accommodate the user's hand without requiring the user to exercise a forceful grip.

Referring to FIGS. 36-40, an alternate embodiment of the exercise devices of the present invention is illustrated. This embodiment has improved strength and flexibility, incorporates all of the desirable features of the previous embodiment, and yet facilitates standardized manufacture of the devices with relatively large variations in weight being readily accommodated. In this alternate embodiment, the peripheral edges of the housing portions have a solid tongue-and-groove mating relationship with one another, and the respective housing portions are secured to respective opposite ends of the weight means.

Like the previous embodiments of the exercise devices described above, the exercise device 100 includes a housing 101 having a weight means disposed therein. Preferably, the wall thickness of this housing 101 is larger than the thickness of the housing wall of the previous embodiments.

As was described for the previous embodiments, a tangential opening 102 is formed in the housing 101.

This opening 102 is bounded by an outer wall 103 and by an inner wall 104. Inner wall 104 has a convex portion 105, and outer wall 103 has a concave portion 106. The hand of the user may be inserted through the tangential opening such that the user's hand is disposed between the inner and outer walls 103 and 104, respectively.

As previously described, the palm of the user's hand is disposed adjacent to the convex portion 105 of the inner wall 104, and the heel of the user's hand is disposed adjacent to the concave portion 106 of the outer wall 103. Thus, a forceful grip is not required by the user during use of the exercise device 100, thereby substantially reducing the necessity for employing the user's conjunctive adjoining muscles, which would (otherwise) have a tendency to detract from the development of the user's targeted muscle.

The opposite ends of the weight means 107 are removably secured to respective diametrically-opposed portions or shells 101A and 101B of the housing 101, and the peripheral annular edges of the respective housing portions 101A and 101B are held together in a solid mating relationship.

Figure 36:
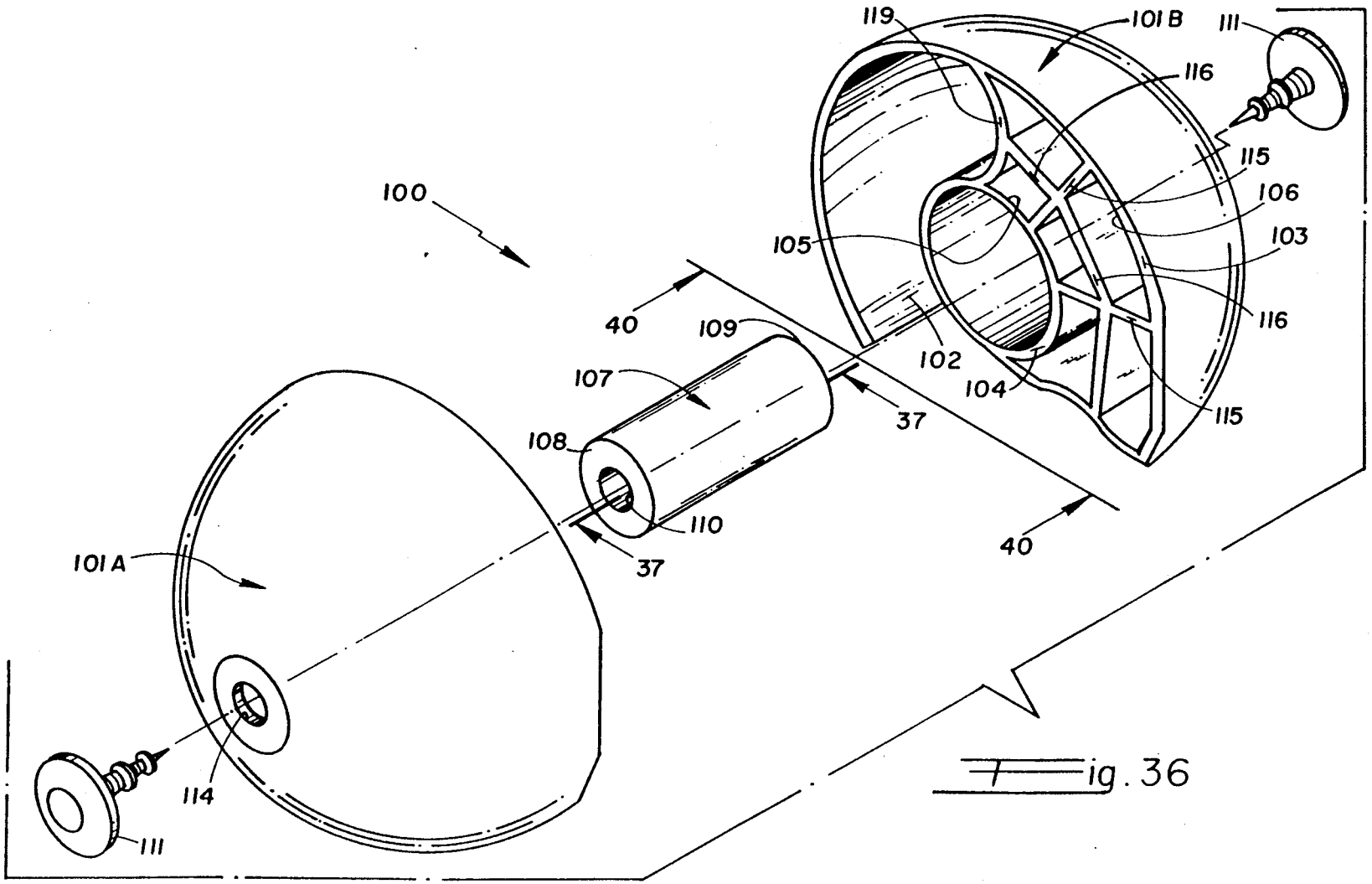
FIG. 36 is an exploded perspective view of a fourth embodiment of the present invention, wherein the ends of the weight are removably secured to the housing portions by cap screws, respectively, and wherein the outer diameter of the weight may be changed to vary the weight of the exercise device.
Figure 37:
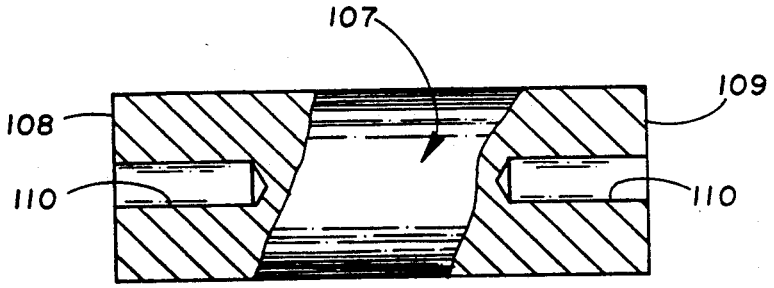
FIG. 37 is a longitudinal cross-section of the weight means, taken along line 37—37 of FIG. 36 and drawn to an enlarged scale.

Referring to FIGS. 36 and 37, preferably the weight means 107 comprises a single solid weight having a pair of opposite ends 108 and 109. It is contemplated herein that this weight 107 (like the cylinder 16 of, for example, FIG. 8) will be substantially cylindrical in cross-section. However, other configurations of the weight means 107 are equally applicable consonant with the teachings of the present invention. Preferably, each of the opposite ends 108 and 109 of the weight 107 has a blind axial bore 110 formed therein. These opposite ends 108 and 109 are secured to the respective diametrically-opposed portions 101A and 101B of the housing 101 by a suitable fastening means.

The annular peripheral edges of the two molded hemispherical housing shells 101A and 101B join together along a common longitudinal midplane constituting the parting line of the housing 101, and the weight 107 is secured between the housing shells 101A and 101B transversely of the common longitudinal midplane therebetween.

The provision of the single weight 107 (secured directly to the housing portions 101A nd 101B) eliminates potential slippage and shifting of the weight in the housing 101. Thus, the exercise device 100 has increased stability during the use thereof.

Having a single weight also standardizes the manufacture of the exercise devices. The effective quantity of the weight 107 may be varied by varying the outer diameter ("O.D.") thereof. In the previous embodiments (described above) the outer diameter of the weight means remains constant, with the effective quantity (or weight) of the weight means being varied by varying the inner diameter thereof. Altering of the inner diameter, or requiring the use of many more weights, is more expensive. In this respect, the use of the single solid weight 107 avoids manufacturing problems, provides standardization, and facilitates an improved product having greater reliability.

Figure 38:
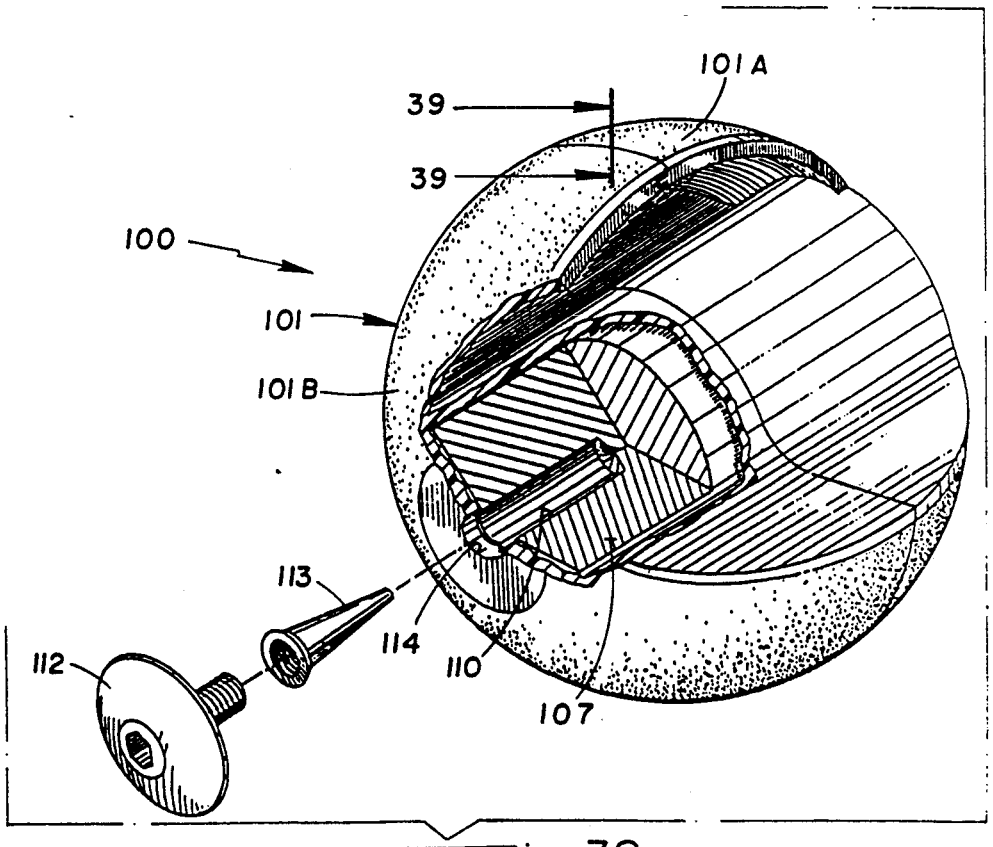
FIG. 38 is a perspective view of the embodiment of FIG. 36 in its assembled relationship, but with certain parts thereof broken away and sectioned, and further showing an alternate fastening means.

The means for securing each of the opposite ends 108 and 109 of the weight 107 to the respective diametrically-opposed portions 101A and 101B of the housing 101 includes a pair of cap screws 111 (or other suitable fastening means). Each of the cap screws 111 is directly inserted and received in a respective bore 110 in the weight 107. These cap screws 111 may be self tapping (as shown in FIG. 36); however, if desired, a screw 112 may cooperate with an expandable anchor 113 which is inserted into the bore 110, as shown in FIG. 38. The anchor 113 expands as the screw 112 is received in the bore 110 in the weight 107. The screws (111 or 112) pass through apertures 114 in the housing portion 101A and 101B, respectively.

In this manner, the housing portions 101A and 101B of the housing 101 are removably secured to the opposite ends 108 and 109, respectively, of the weight 107, such that the housing portions 101A and 101B are removably secured to each other.

Figure 40:
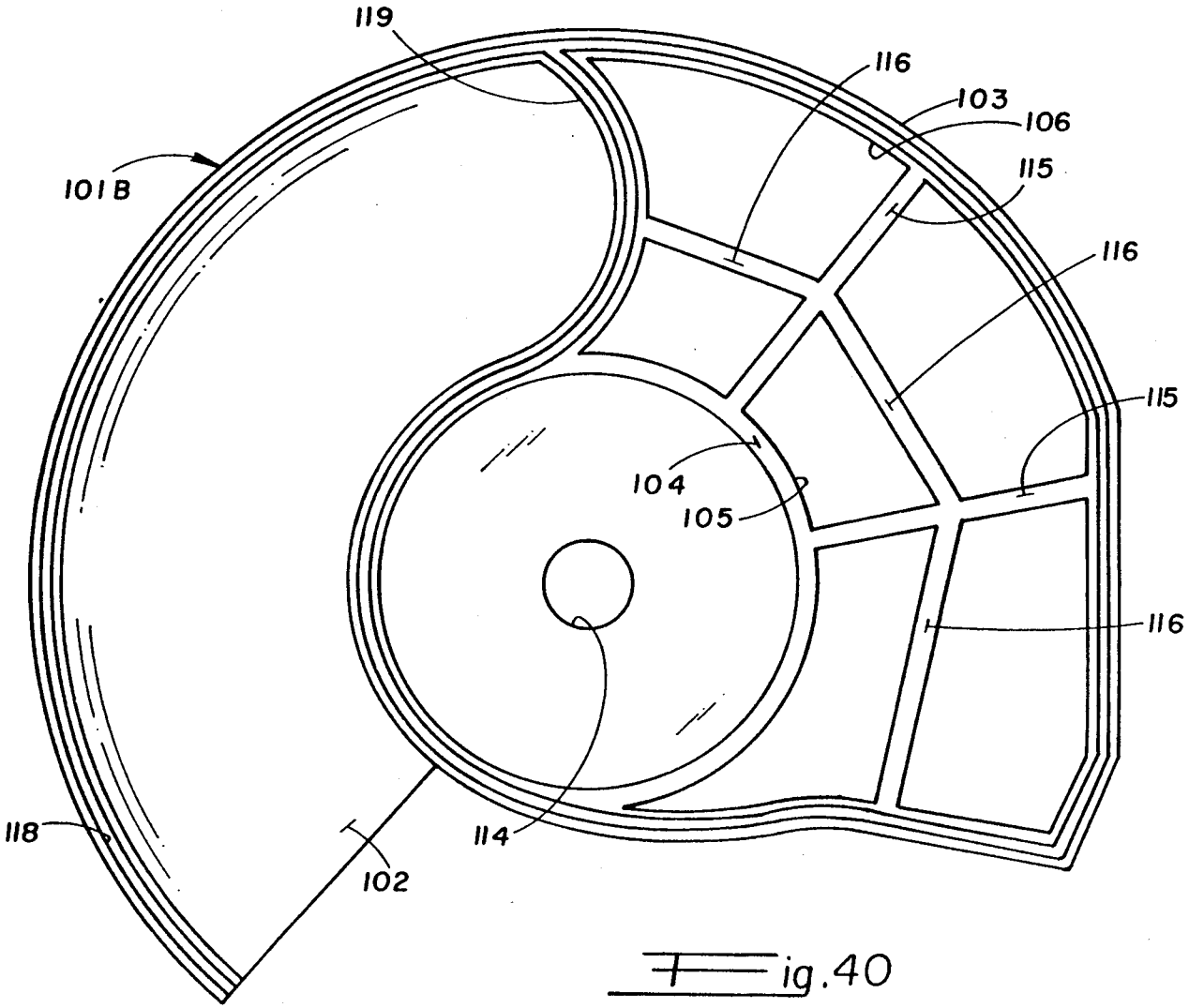
FIG. 40 is a first elevational view of one of the housing portions or shells, as viewed from the lines 40—40 of FIG. 36 and drawn to an enlarged scale.

Each housing portion 101A and 101B has a plurality of radially-extending respective strengthening ribs (or struts) 115 formed thereon, as shown more clearly in FIG. 40. These struts 115 extend between the inner (convex) wall 104 and the outer (concave) wall 103 of each housing half 101A and 101B. Additionally, cross ribs 116 join the struts 115 (being integrally molded therewith) to provide additional radial and circumferential strength to the housing portions 101A and 101B. These struts 115 and cross ribs 116 are desirable where a particularly heavy weight (i.e. forty pounds or heavier) is disposed in the exercise device 100 (but may not be necessary where lighter weights are employed).

Figure 39:
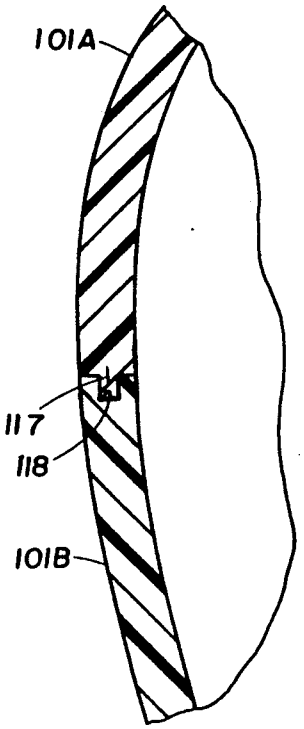
FIG. 39 is a partial cross-sectional view thereof, taken along the lines 39—39 of FIG. 38 and drawn to an enlarged scale, and showing the tongue-and-groove mating relationship of the two hemispherical housing portions or shells along their respective annular peripheries.
Figure 41:
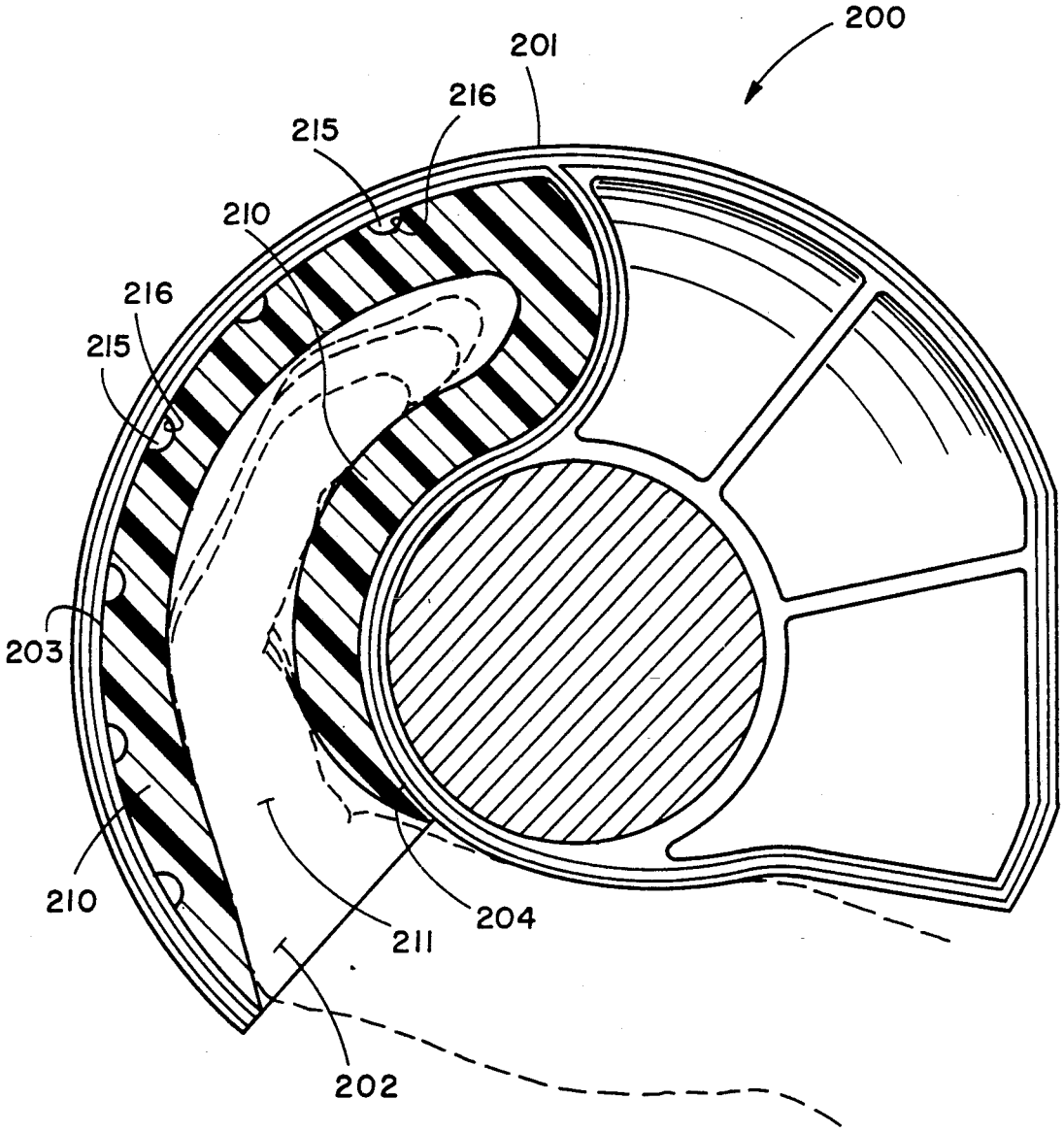
FIG. 41 is a cross sectional view of the exercise device to show the insert of foam material with the positioning of the user's hand therein.

Referring to FIG. 39, in addition to FIG. 36, the housing portions 101A and 101B are keyed together by a tongue-and groove arrangement, which permits the peripheral edges of the housing portions 101A and 101B to mate solidly with one another. In this arrangement, the annular peripheral edge of one of the housing portions 101A (or 101B) has an annular tongue 117 formed thereon; and the annular peripheral edge of the other of the housing portions 101B (or 101A) has a complementary annular groove 118 formed therein and sized so as to receive the tongue 117 therein in a mating relationship. This tongue-and-groove arrangement provides greater security against slippage or relative movement of the housing portions 101A and 101B relative to one another, especially when the exercise device 100 is under greater stress due to the use of heavier weights.

An internal wall 119 (see FIG. 36) limits the insertion of the user's hand in the exercise device 100 (similar to the internal wall shown in FIG. 3 of the previous embodiments). This internal wall 119 projects radially and joins the inner wall 104 to the outer wall 103.

Referring to FIGS. 41 to 44, an insert means 210 is provided in the opening 202 in the housing 201. The insert means 210 is disposed between the outer wall 203 and the inner wall 204. The insert means 210, in at least one embodiment, is in contact with the inner wall 203 and the outer wall 204. In this embodiment, an opening 211 is formed in the insert means 210 whereby the user's hand may be received in the opening 211. In this manner, the insert 210 is disposed between at least the fingers and possibly a portion of the palm of the user's hand and the convex portion of the inner wall 204. The extent to which the palm of the user's hand is in contact with the inner wall 204 depends on the size of the user's hand and the manner in which the user's hand is inserted into the opening 202 in the exercise device. The insert 211 is also disposed between the back of the user's hand and the concave portion of the outer wall 203. The insert 210 may be a plastic foam type of material and preferably, is a high density urethane foam. The insert 210 substantially covers the user's hand during use of the device and provides a comfortable cushion for the user's hand.

The insert 210 also may be removable. This provides several additional useful features for the device. A removable insert 210 may be cleaned or sterilized for hygienic reasons which is very important in those facilities where the exercise means may be used by more than one person. Even when used by the same person, it would be beneficial to remove the insert for periodic cleaning. Also, a removable insert 210 allows for replacement when the insert is damaged or when the exercise device may be used by persons having hands which are significantly different in size from the other hands of other persons using the device. It is possible to obtain an insert 210 of a size or thickness which is most comfortable for the hand of the individual user.

A preferred embodiment to permit removal of the insert 210 provides a plurality of spaced apart protrusions 215 on the outer wall 203, the protrusions 215 extending toward the inner wall 204. The insert 210 is provided with a corresponding plurality of spaced apart apertures formed therein. The apertures 216 receive the protrusions 215 and retain the insert 210 within the opening 202. Alternately, the apertures may be formed in the outer wall 203 and the protrusions formed on the insert 210 to permit the insert 210 to be retained in the opening 202.

Figure 42:
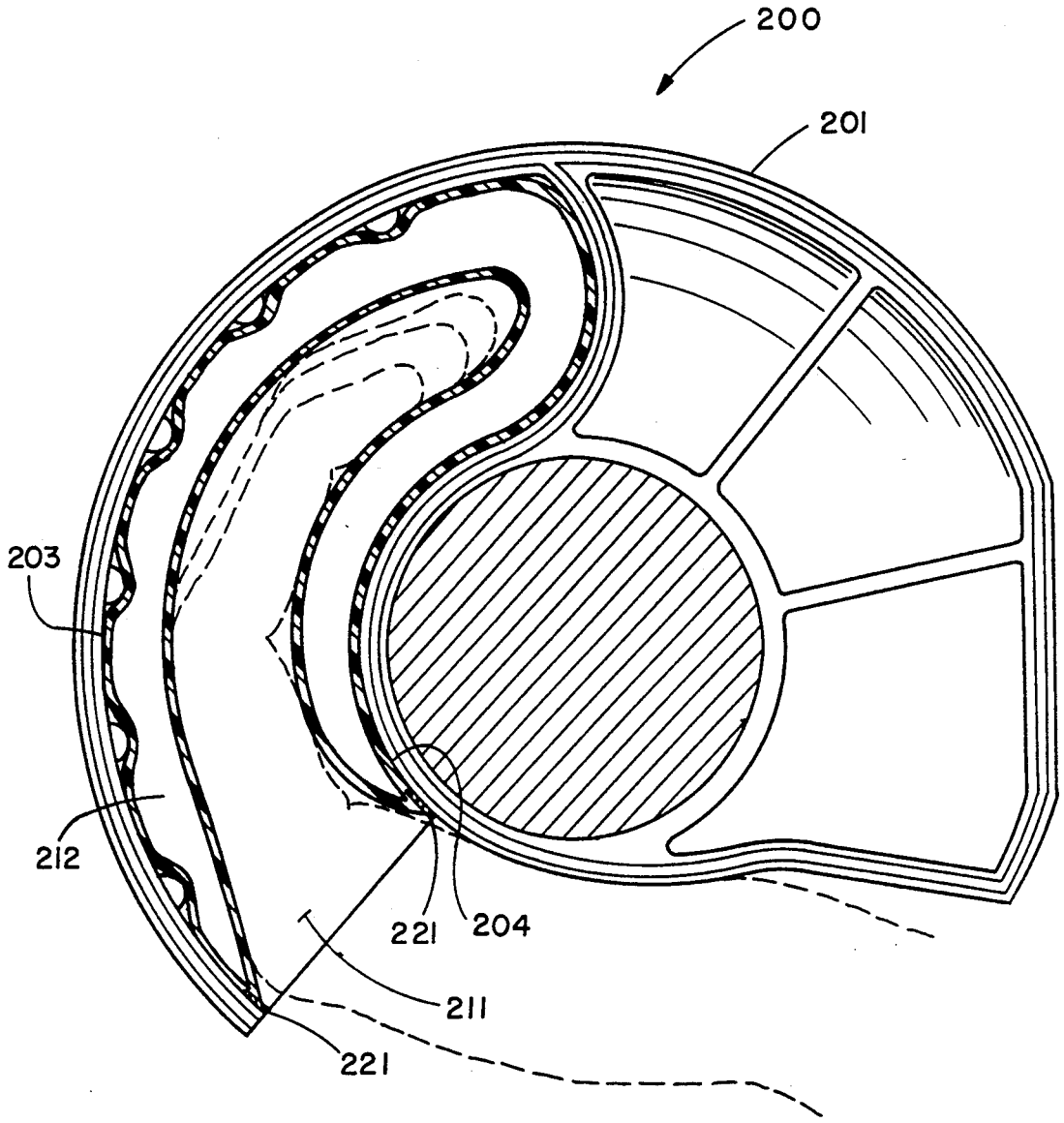
FIG. 42 is a cross sectional view of the exercise device to show the insert of the inflatable bladder with the positioning of the user's hand therein.
Figure 43:
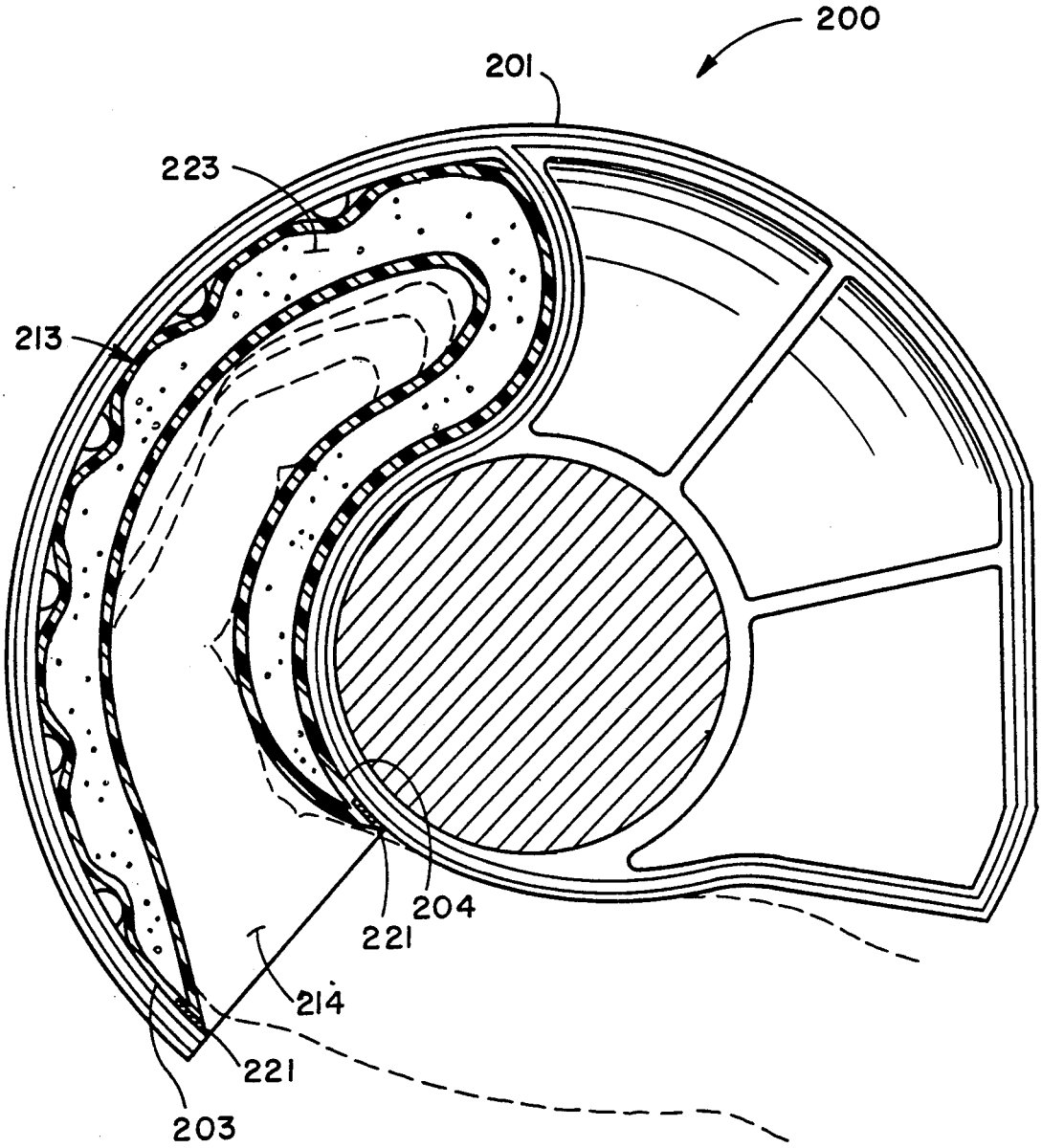
FIG. 43 is a cross sectional view of the exercise device to show the bladder containing liquid with the positioning of the user's hand therein.

Alternatively, as shown in FIG. 42, the insert means 210 may be an inflatable bladder 212 which may be disposed in the opening 202 in the device 200 between the outer wall 203 and the inner wall 204. The inflatable bladder 212 contacts the walls 203, 204 and has an opening 211 therein to receive the user's hand. The inflatable bladder 212 is thereby disposed between at least the fingers, and possibly a portion of the palm of the user's hand, and the convex portion of the inner wall 204. The inflatable bladder 212 is also disposed between the back of the user's hand and the concave portion of the outer wall 203. The inflatable bladder 212 may be inflated with gas, such as air, to a desired level. When so inflated, the inflatable bladder 212 substantially conforms to the user's hand. In this manner, the means 210 may be individually varied to provide the most comfortable fit for the user's hand and is adaptable to a wide variation in the size of the hand. Further, the opening 211 in the inflatable bladder 212 may be washed, or cleaned by other means, for hygienic purposes.

Figure 45:
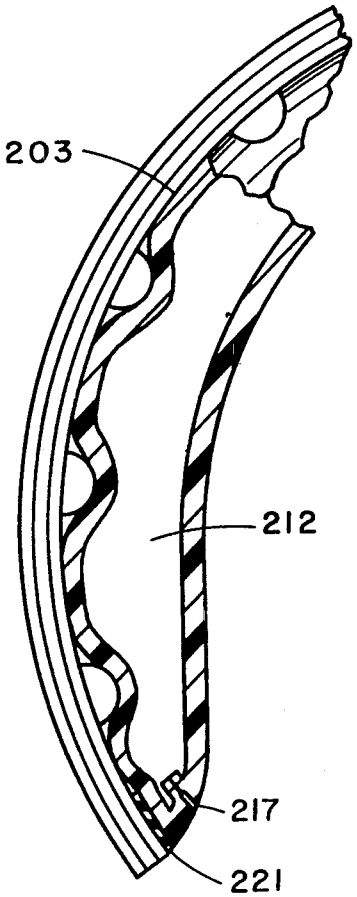
FIG. 45 is an enlarged partial section view of FIG. 42 stowing a valve disposed on the inflatable bladder.

Means are also provided to inflate the bladder 212. A preferred means is a valve 217 disposed in the bladder such that a source of air pressure may be connected to the valve to introduce air into the inflated bladder 212 (FIG. 45). This valve 217 may be of the type used in the bicycle tire or toy which is inflated with a hand pump (the source of air pressure). Such valves are well known to persons skilled in the art. Alternately, (FIG. 46) the valve 217 may be disposed on the inflatable bladder 212 to cooperate with an aperture 220 in the outer wall 203 of the housing 201 such that the source of air pressure may be connected to the valve 217 through the aperture 220 in the outer wall 203.

Figure 48:
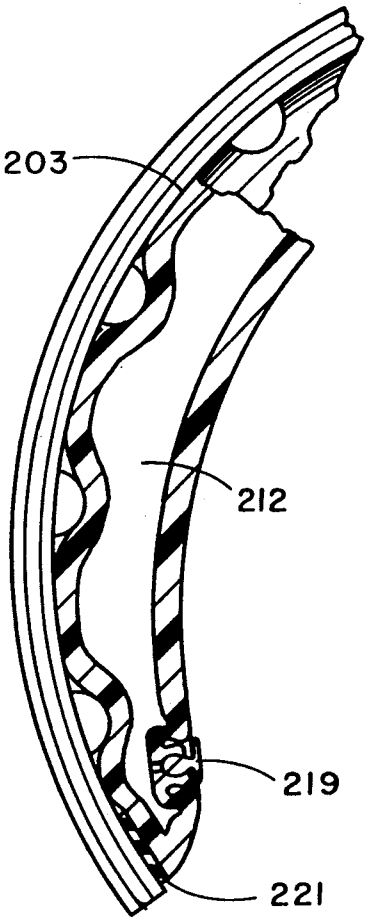
FIG. 48 is an enlarged partial section view of FIG. 42 showing a tube on the inflatable bladder for introduction of air into the bladder.
Figure 47:
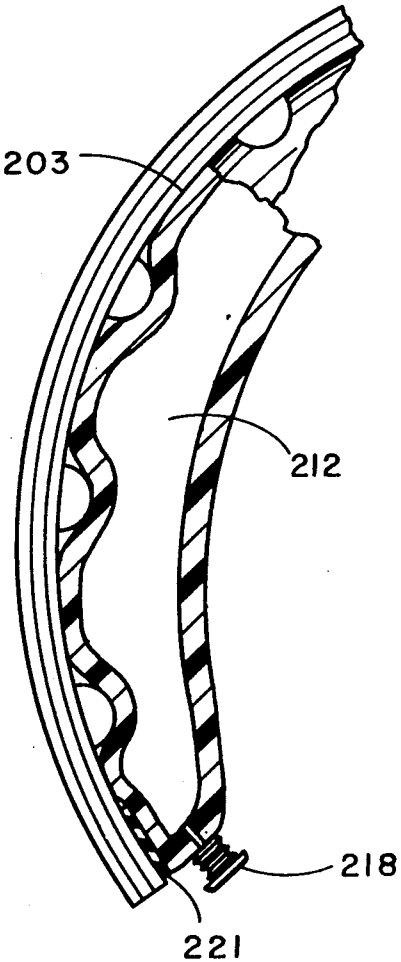
FIG. 47 is an enlarged partial section view of FIG. 42 showing a collapsible bellows pump attached to the inflatable bladder.

In still another embodiment (FIG. 47), a compact bellows type pump 218, which is manually operated, is disposed on the inflatable bladder 212. This may be a plastic bellows type pump which may be folded against the inflatable bladder 212 to be available when needed. Referring to FIG. 48, another means of inflating the bladder 212 is a tube 219 attached to the bladder 216 and communicating therewith. The tube 219 may be placed in the user's mouth and the bladder inflated with air from the user's lungs. Means are provided to prevent the air from exiting the tube and deflating the bladder 212. This type of inflation means is similar to that used with a beach ball. The tube 219 may be folded and received in a depression formed in the bladder 212 so as to be inconspicuous and ready for immediate use. The inflation means shown in FIGS. 45–48 are simple, economical to manufacture and are sufficiently small as to be compatible with the exercise device.

The inflatable bladder 212 has an edge which is disposed about the opening 202 of the device 200. The edge of the bladder 212 is adhered (by an adhesive 221) about the opening 202 of the device 200 so as to fully seal the bladder 212 to the opening 202 and prevent deflation of the bladder 212. Other means known to persons skilled in the art may be used to seal the edge of the bladder 212 to the opening 202 to prevent deflation of the inflatable bladder 212.

In still another embodiment (FIG. 43) the insert means 210 is a bladder 213 having a liquid contained therein. The bladder containing the liquid 213 is disposed in the opening 202 in the device 200 between the outer wall 203 and the inner wall 204. The bladder containing the liquid 213 contacts the walls 203, 204 and has an opening 214 therein to receive the user's hand. The bladder containing the liquid 213 is thereby disposed between at least the fingers, and possibly a portion of the palm of the user's hand, and the convex portion of the inner wall 204. The bladder containing the liquid 213 is also disposed between the back of the user's hand and the concave portion of the outer wall 203. The bladder containing liquid 213 substantially conforms to the user's hand during use of the device 200. The liquid 223 contained in the bladder may be water, a silicone, a gel or any other viscous material (known to persons skilled in the art) which may be stable, pliable and relatively inexpensive. The bladder containing the liquid 213 has an edge which is disposed about the opening 202 of the device 200. The edge of the bladder containing the liquid 213 is adhered (by an adhesive 221) about the opening 202 between the inner wall 204 and the outer wall 203 of the device 200 to retain the bladder containing the liquid 213 in the opening 202. Further, the opening 214 in the bladder containing the liquid 213 may be washed, or cleaned by other means, for hygienic purposes.

The means 210 (foam insert, the inflatable bladder insert and the bladder containing liquid) may have a fabric cover disposed between the insert means 210 and the user's hand such that the fabric cover may be cleaned and replaced.

Figure 44:
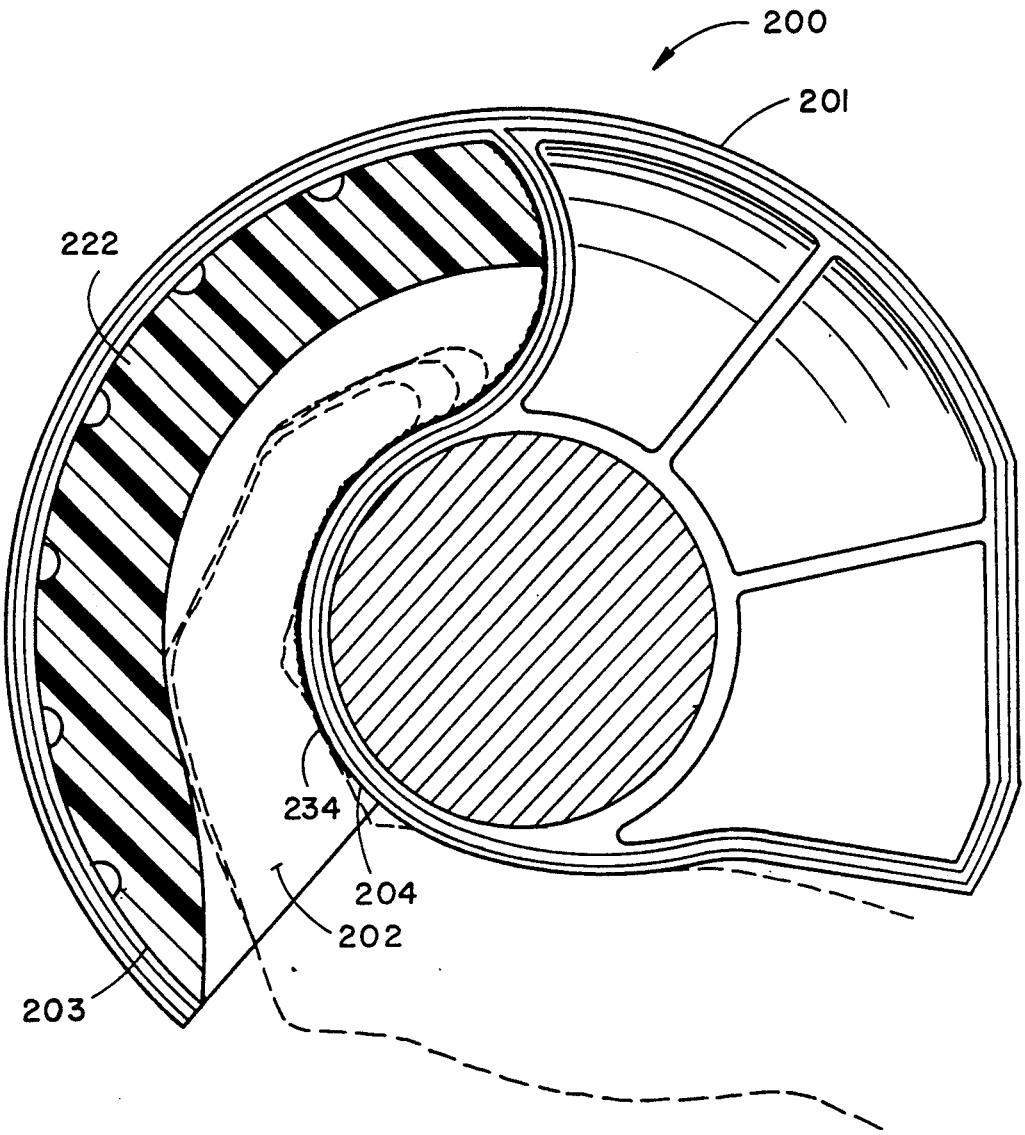
FIG. 44 is a cross sectional view of the exercise device to show the insert pad on the outside wall with the positioning of the user's hand relative to the insert pad.
Figure 46:
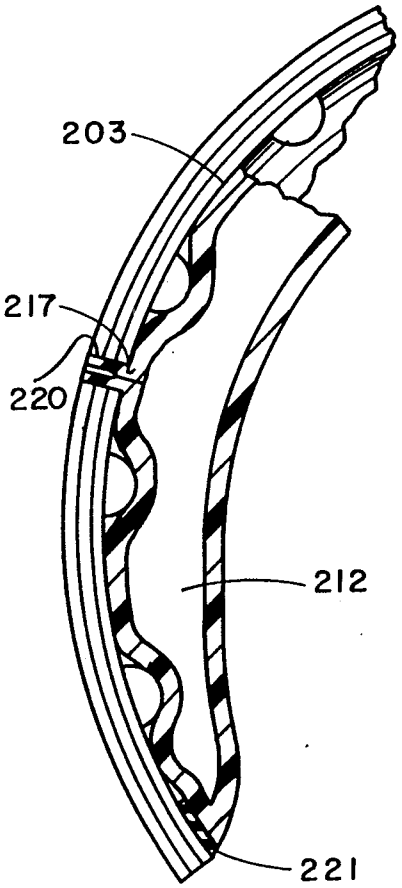
FIG. 46 is an enlarged partial section view of FIG. 42 showing an aperture in the outer wall and a valve disposed in the inflatable bladder.

Another embodiment of the insert means 210 is shown in FIG. 44. A single insert pad 222 is attached to the outer wall 203 of the device 200 such that the back of the user's hand is substantially in contact with the insert pad 222. Preferably, the insert pad 222 is a high density urethane foam material. The insert pad has a thickness which may be selected to provide the comfort required for the size of the individual user's hand. The insert pad 222 may be adhered to the outer wall 203 by adhesive or other means known to those skilled in the art.

In all of the above described insert means 210, the color of the insert means 210 may be selected as desired. Colored inserts may be used to identify the exercise device belonging to a specific individual or organization.

Figure 49:
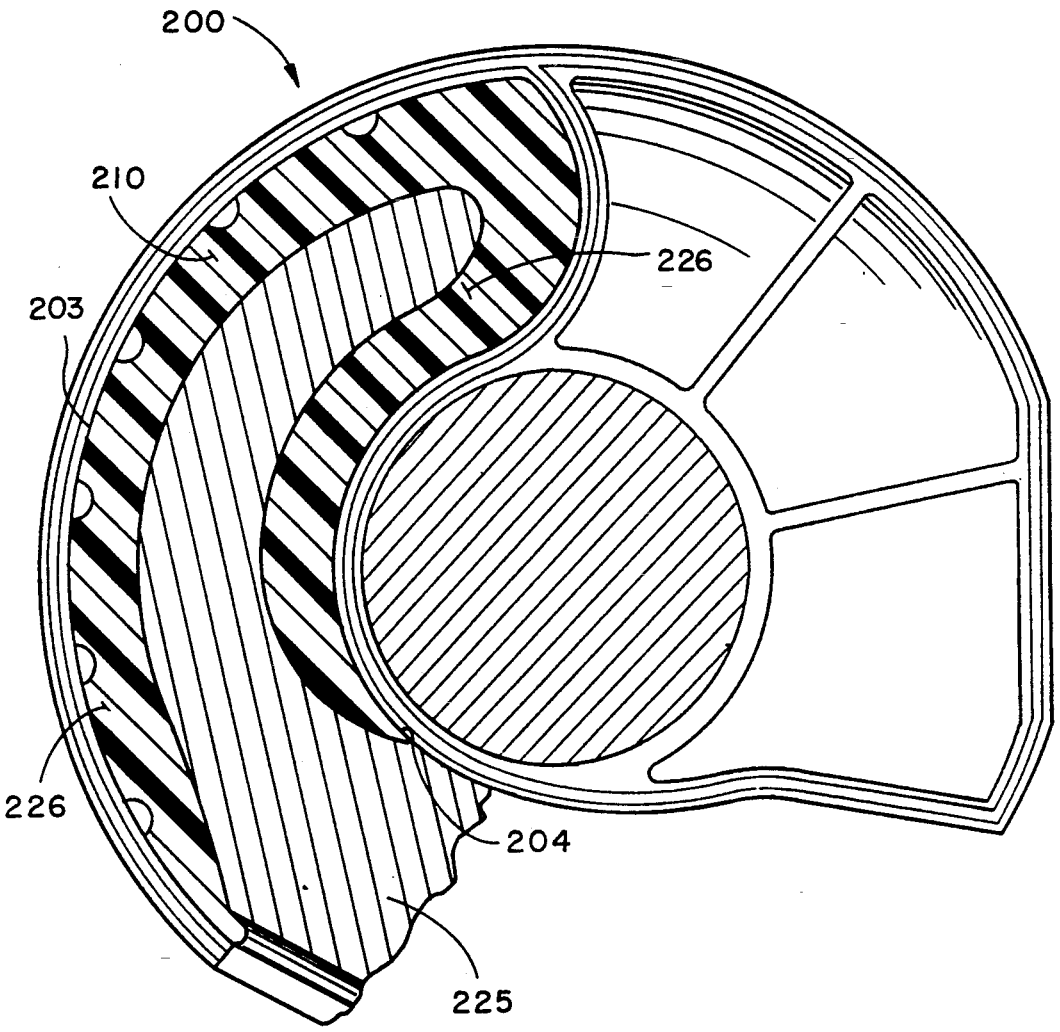
FIG. 49 is a cross sectional view of the exercise device showing a tongue-like form in the opening to form the insert of FIG. 41.

Referring to FIG. 49, the plastic foam insert means 210 may be fabricated by placing a tongue-like form 225 in the opening 202 defined by the outer wall 203 and the inner wall 204. The tongue-like form 225 is spaced apart from the inner wall 204 and also from the outer wall 203. A space 226 is formed between the tongue-like form 225 and the inner wall 204 which communicates with the space 226 between the tongue-like form 225 and the outer wall 203. A foam material such as high density urethane is disposed in the space 226 between the tongue-like form 225 and the outer wall 203 and the communicating space 226 between the tongue-like form 225 and the inner wall 204. The space 226 is completely filled with the foam material. The foam material is cured (allowed to "set-up") and the tongue-like form 225 is removed from the opening 202. In this manner, the insert means 210 is formed on the inner wall 204 and the outer wall 203 of the opening 202 in the exercise device such that the user's hand may be received in the opening from which the tongue-like form 225 was removed. The dimensions of the tongue-like form 225 determine the thickness and configuration of the insert means 210. Thus, a tongue-like form 225 which occupies a greater volume in the opening 202 such that the space 226 between the tongue-like form 225 and the walls 203, 204 is reduced, produces an insert means 210 which has reduced thickness and is more comfortable for a user having a larger hand. Conversely, a tongue-like form 225 occupying a smaller volume, and hence an increased space 226 between the tongue-like form 225 and the walls 203, 204, is preferred for a user having a smaller hand. If a colored insert means 210 is desired, the desired color can be introduced into the foam material.

Figure 50:
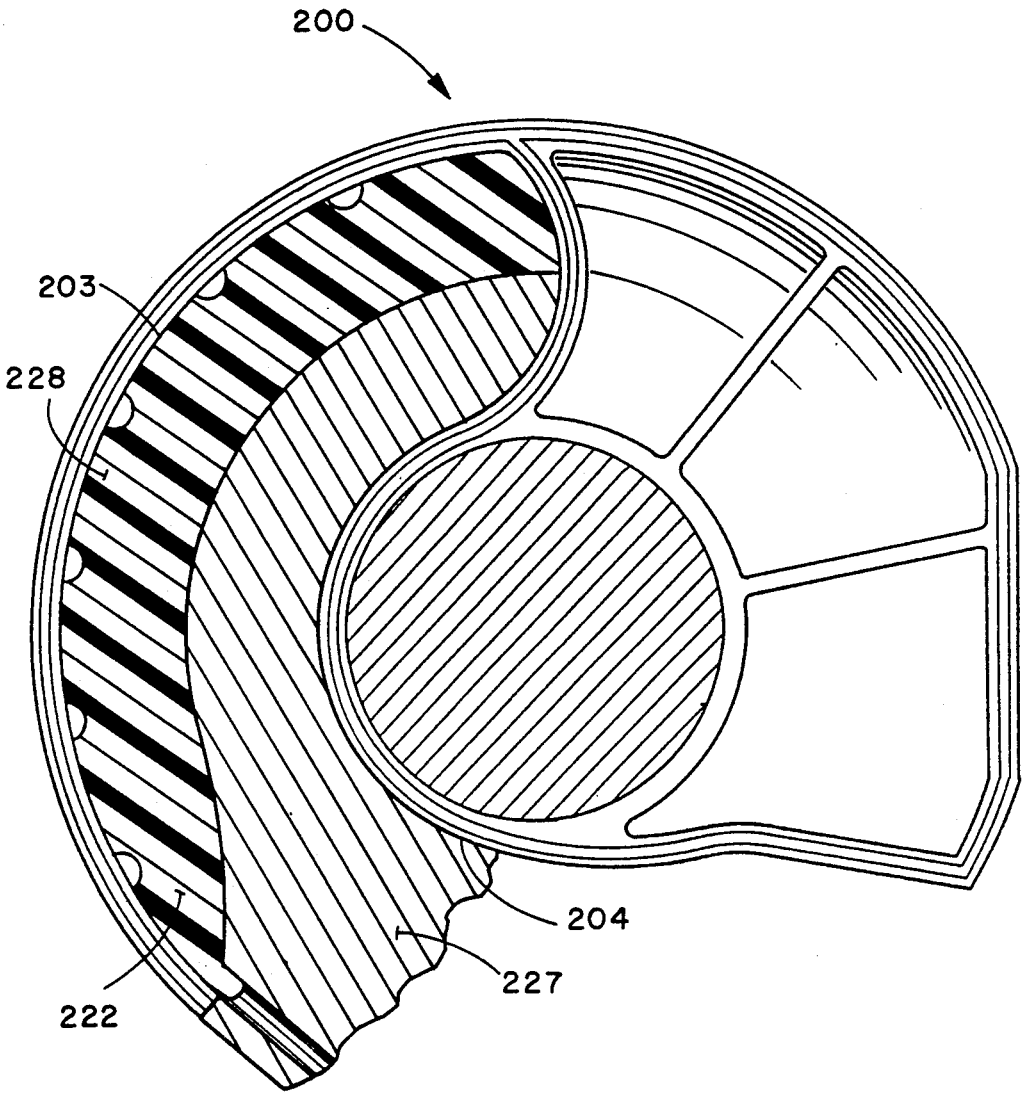
FIG. 50 is a cross sectional view of the exercise device showing a form in the opening to form the insert of FIG. 44.

Referring to FIG. 50, the pad insert means 222 may be fabricated by placing a form 227 in the opening 202. The form 227 is in contact with the inner wall 204 and spaced apart from the outer wall 203 forming a space 228 between the form 227 and the outer wall 203. A foam material is disposed in the space 228 between the form 227 and the outer wall 203 such that the space 228 is completely filled with foam material. The foam material is cured and the form 227 is removed from the opening 202. Thus, ar insert pad 222 is formed in contact with the outer wall 203 such that the back of the user's hand rests against the insert pad 222 which acts as a cushion for the user's hand. The thickness of the insert pad 222 is determined by the dimensions of the form 227, a thicker insert pad 222 being obtained with a thinner form 227 and a thinner insert pad 227 being obtained with a thicker form 227. The thickness of the insert pad 227 is selected to cushion the user's hand more effectively. Color may be added to the foam material if desired, to produce a colored insert pad 227. Also, adhesive material may be disposed on the outer wall 203 prior to introducing the foam material in order to more effectively retain the insert pad 227 against the outer wall 203.

As a further aid in comfort in using the device and for improved contact between the palm of the user's hand and the exercise device 200, the convex portion of the inner wall 204, if desired, may have a textured surface 234 thereon (FIG. 44).

Figure 51:
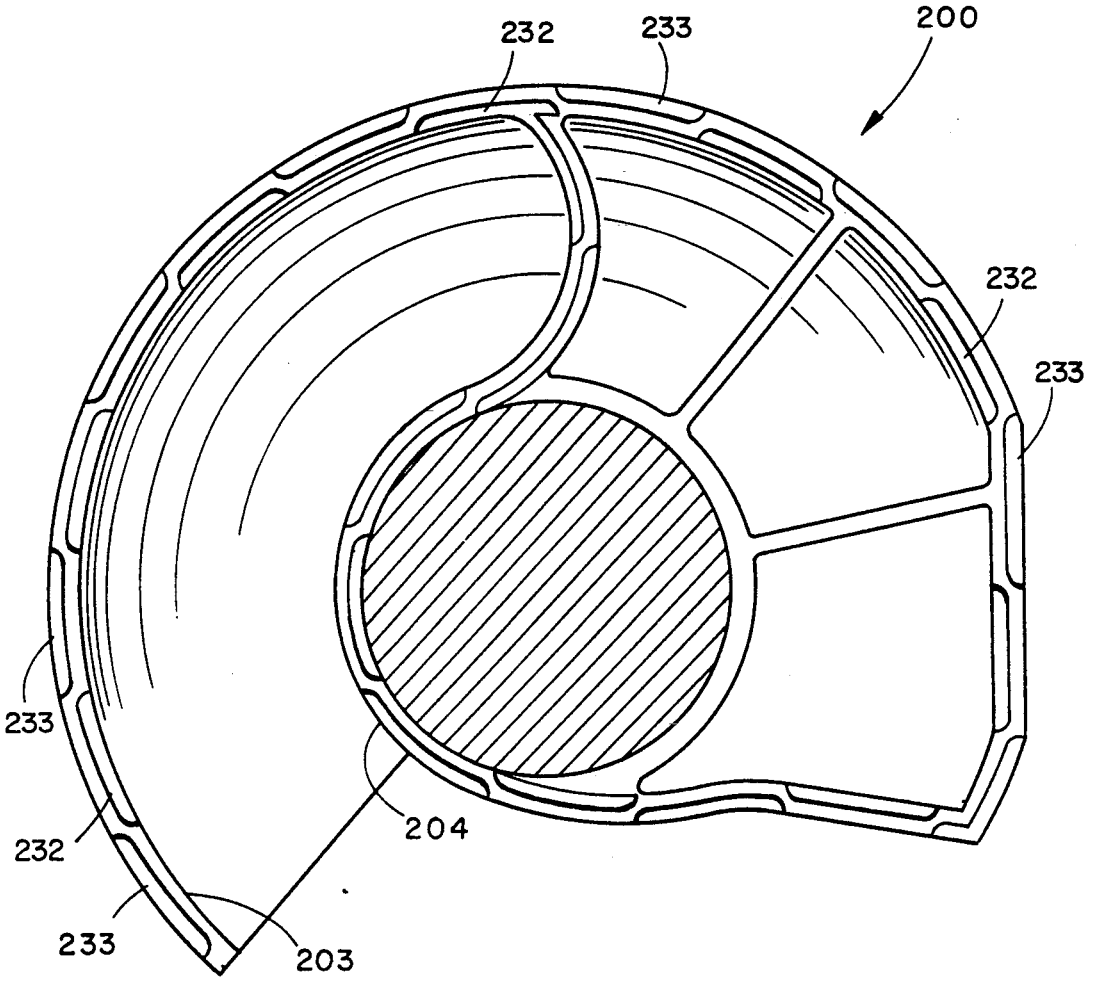
FIG. 51 is an elevational view of one of the housing portions showing alternating tongue and groove segments on the peripheral edge of the housing portion.
Figure 52:
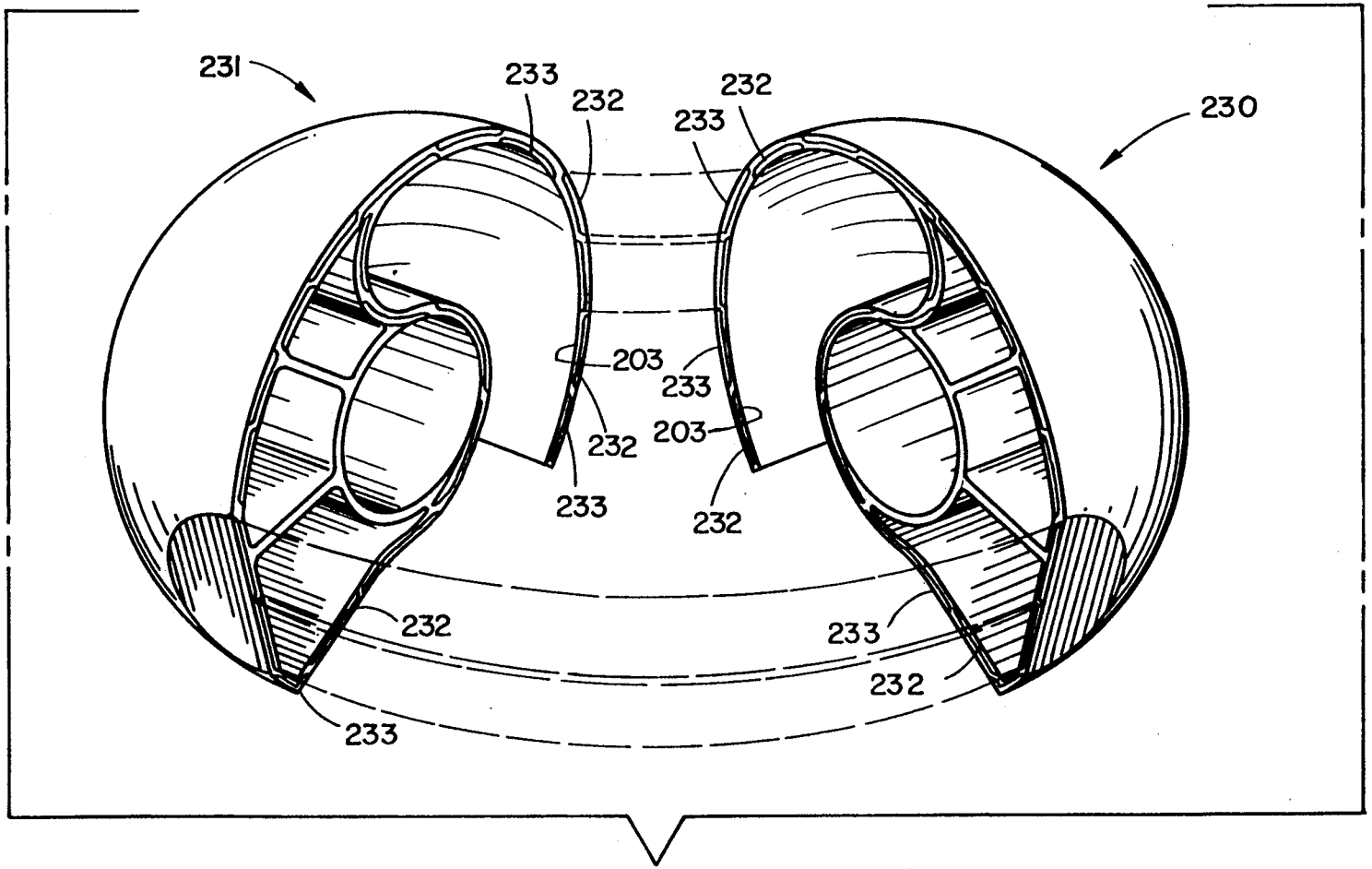
FIG. 52 is a perspective view of the exercise device showing joining of the housing portions to engage the respective tongue and groove segments of the housing portion.

As previously described and as shown in FIGS. 36 and 39, the housing portions may be mated by a tongue and groove arrangement. In an alternate embodiment shown in FIGS. 51 and 52, the housing portions 230 and 231 may have a plurality of segments formed on the peripheral edges of the respective housing portions 230, 231. Each segment alternately has a tongue 232 formed thereon and a groove 233 formed thereon. The configuration of the alternating tongue segment 232 and groove segment 233 in the one of the housing portions 230 is the reverse of the configuration of the tongue segment 232 and the groove segment 233 in the other of the housing portions 231. As seen in FIG. 52 when the respective peripheral edges of the housing portions 230, 231 mate, the tongue segments 232 in the respective segments of the one of the housing portions 230 is received in the groove segments 233 of the other of the housing portions in a mating relationship. Also, the tongue 232 in the respective segments of the other of the housing portions 231 is received in the groove 233 in the respective segment of the one of the housing portions 230 in a mating relationship. This arrangement provides improved security against slippage or relative movement of the housing portions 230 and 231 with respect to one another.

Figure 53:
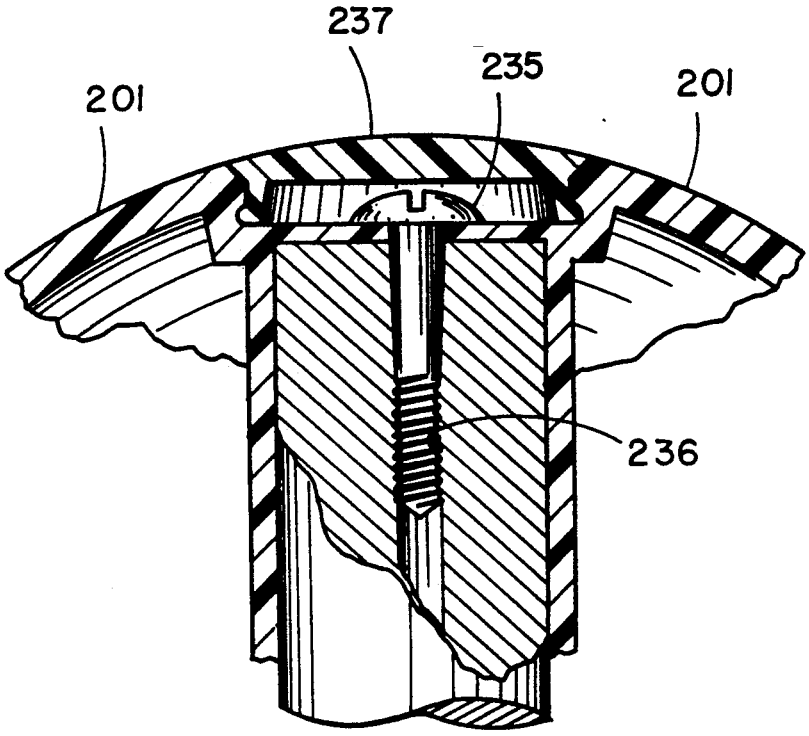
FIG. 53 is an enlarged cross section view of the cover on the cap screw.

In still a further embodiment, when the housing portions 230 and 231 mate to form an integral housing, the integral housing has a substantially smooth surface. The weight is secured in the housing by a pair of cap screws 235 which are inserted in and received by a respective bore 236 in the weight. The cap screws 235 may be self tapping or any type previously described. As shown in FIG. 53, a cover 237 is removably mounted on each cap screw 235 such that the covers 237 are substantially flush with the surface of the housing. This may be achieved by having a beveled opening in the housing 230, 231 into which the cover 237 may be disposed. The cover may be disposed in the opening by a pressure fit. It is recognized by those skilled in the art that other means for placing the cover in the opening may be used.

Having thus described the invention, it will accordingly be appreciated by those skilled in the art that within the scope of the appended claims, the invention may be practiced other than has been specifically described therein.

What is claimed is:

1. An exercise device comprising a substantially spherical housing including a pair of complementary housing portions joined together along a common midplane, the housing portions having an opening therebetween for receiving the user's hand, wherein when the user's hand is received through the opening in the exercise device, a forceful grip is not required during use of the device, thereby substantially avoiding use of the user's conjunctive adjoining muscles, and thereby substantially strengthening the user's targeted muscle, a weight within the exercise device said weight being located in the housing substantially at right angles to the common midplane between the housing portions, such that when the user's hand is inserted through the opening in the housing, the hand is at least partially disposed around the weight radially thereof, and a cushioned insert within the opening in the exercise device and substantially between the user's hand and the exercise device, whereby the insert contributes to the user's convenience and comfort during use of the device.

2. The exercise device of claim 1, wherein the insert is removable from the opening in the exercise device.

3. In an exercise device comprising a housing including a pair of complementary diametrically-opposed housing portions, the housing having a weight means disposed therein and further having an opening formed therein substantially tangentially of the housing, the opening being bounded by an outer wall having a concave portion and an inner wall having a convex portion, whereby the hand of the user may be inserted through the opening in the housing, such that the user's hand is disposed between the inner and outer walls, such that at least the fingers of the user's hand rest substantially on the convex portion of the inner wall, and such that the back of the user's hand rests substantially on the concave portion of the outer wall, whereby a forceful grip is not required by the user, and whereby the necessity for employing the user's conjunctive adjoining muscles is substantially reduced, thereby substantially reducing the tendency to detract from the development of the user's targeted muscle, and the weight means having a pair of opposite ends, each of which is secured to a respective housing portion, an improvement comprising an insert means provided in the opening in the housing between the outer wall and the inner wall thereby cushioning the user's hand.

4. The exercise device of claim 3, wherein the insert means is in contact with the outer wall and with the inner wall, the insert having an opening formed therein whereby the user's hand may be received in the opening in the insert means such that the insert means is disposed between at least the fingers of the user's hand and the convex portion of the inner wall and the insert means is disposed between the back of the user's hand and the concave portion of the outer wall.

5. The exercise device of claim 4, wherein the insert means is a plastic foam.

6. The exercise device of claim 5, wherein the insert means is a high density urethane foam.

7. The exercise device of claim 4, wherein the insert means is an inflatable bladder which may be inflated to a desired level to conform to the user's hand.

8. The exercise device of claim 4, wherein the insert means is a bladder having a liquid contained therein.

9. The exercise device of claim 3, wherein the insert means is a pad attached to the outer wall of the opening whereby the back of the user's hand rests substantially on the pad.

10. The exercise device of claim 9, wherein the pad is a high density urethane foam.

11. An exercise device having an opening formed therein through which the hand of the user may be inserted, the opening being defined by a pair of walls in the device and including an inner wall and an outer wall, the outer wall having a plurality of spaced apart protrusions extending toward the inner wall, an insert disposed in the opening between the inner wall and the outer wall, the insert having a corresponding plurality of spaced apart apertures formed therein and receiving the respective protrusions such that the insert is retained in the opening, whereby the user's hand is substantially curved around the inner wall and is disposed within the insert between the inner wall and the outer wall, the insert substantially covering the user's hand during use of the device, respectively, and a weight means disposed substantially centrally of the device and within the inner wall thereof, such that a forceful grip of the user's hand on the weight means is not necessary, and such that the necessity for employing the user's conjunctive adjoining muscles is substantially reduced, thereby substantially reducing the tendency to detract from the development of the user's targeted muscle.

12. The exercise device of claim 11, wherein the insert is a high density urethane foam.

13. An exercise device having an opening formed therein through which the hand of the user may be inserted, the opening being defined by a pair of walls in the device and including an inner wall and an outer wall, an insert means disposed in the opening between the inner wall and the outer wall, whereby the user's hand is substantially curved around the inner wall and is disposed within the insert means between the inner wall and the outer wall, respectively, the insert means substantially covering the user's hand during use of the device, and a weight means disposed in the device, such that a forceful grip of the user's hand on the weight means is not necessary, and such that the necessity for employing the user's conjunctive adjoining muscles is substantially reduced, thereby substantially reducing the tendency to detract from the development of the user's targeted muscle, wherein the outer wall has a plurality of spaced apart protrusions extending toward the inner wall, the insert means having a corresponding plurality of spaced apart apertures formed therein and receiving the respective protrusions such that the insert means is retained in the opening and may be removed form the opening for cleaning and replacement.

14. An exercise device having an opening formed therein through which the hand of the user may be inserted, the opening being defined by a pair of walls in the device and including an inner wall and an outer wall, an insert means disposed in the opening between the inner wall and the outer wall, whereby the user's hand is substantially curved around the inner wall and is disposed within the insert means between the inner wall and the outer wall, respectively, the insert means substantially covering the user's hand during use of the device, and a weight means disposed in the device, such that a forceful grip of the user's hand on the weight means is not necessary, and such that the necessity for employing the user's conjunctive adjoining muscles is substantially reduced, thereby substantially reducing the tendency to detract from the development of the user's targeted muscle, wherein the outer wall has a plurality of spaced apart protrusions extending toward the inner wall, the insert means having a corresponding plurality of spaced apart apertures formed therein and receiving the respective protrusions such that the insert means is retained in the opening and may be removed from the opening for cleaning and replacement, and, wherein the insert means is high density urethane foam.

15. An exercise device having an opening formed therein through which the hand of the user may be inserted, the opening being defined by a pair of walls in the device and including an inner wall and an outer wall, an insert means disposed in the opening between the inner wall and the outer wall, whereby the user's hand is substantially curved around the inner wall and is disposed within the insert means between the inner wall and the outer wall, respectively, the insert means substantially covering the user's hand during use of the device, and a weight means disposed in the device, such that a forceful grip of the user's hand on the weight means is not necessary, and such that the necessity for employing the user's conjunctive adjoining muscles is substantially reduced, thereby substantially reducing the tendency to detract form the development of the user's targeted muscle, wherein the insert means has a plurality of spaced apart protrusions extending toward the outer wall and the outer wall has a corresponding plurality of spaced apart apertures formed therein and receiving the protrusions such that the insert means is retained in the opening and may be removed from the opening for cleaning and replacement.

16. An exercise device having an opening formed therein through which the hand of the user may be inserted, the opening being defined by a pair of walls in the device and including an inner wall and an outer wall, an insert means disposed in the opening between the inner wall and the outer wall, whereby the user's hand is substantially curved around the inner wall and is disposed within the insert means between the inner wall and the outer wall, respectively, the insert means substantially covering the user's hand during use of the device, and a weight means disposed in the device, such that a forceful grip of the user's hand on the weight means is not necessary, and such that the necessity for employing the user's conjunctive adjoining muscles is substantially reduced, thereby substantially reducing the tendency to detract from the development of the user's targeted muscle, wherein the insert means has a plurality of spaced apart protrusions extending toward the outer wall and the outer wall has a corresponding plurality of spaced apart apertures formed therein and receiving the protrusions such that the insert means is retained in the opening and may be removed from the opening for cleaning and replacement, and, wherein the insert means is high density urethane foam.

17. An exercise device comprising a housing including a pair of complementary diametrically-opposed housing portions, the housing having a weight means disposed therein and further having an opening formed therein substantially tangentially of the housing, the opening being bounded by an outer wall having a concave portion and an inner wall having a convex portion, whereby the hand of the user may be inserted through the opening in the housing, such that the user's hand is disposed between the inner and outer walls, such that at least the fingers of the user's hand rest substantially on the convex portion of the inner wall and said weight means located in the housing such that at least the fingers of the user's hand rest at least partially around the weight means radially thereof, whereby a forceful grip is not required by the user, and whereby the necessity for employing the user's conjunctive adjoining muscles is substantially reduced, thereby substantially reducing the tendency to detract from the development of the user's targeted muscle; the housing portions having respective peripheral edges along which the housing portions mate, the peripheral edge of each housing portion having a plurality of segments formed therein, each segment alternatively having a tongue formed thereon and a groove formed therein; the configuration of the alternating tongue and groove segments in the one of the housing portions being the reverse of the configuration of the tongue and groove segments in the other of the housing portions; such that when the respective peripheral edges of the housing portion mate, the tongue on the respective segment of the one of the housing portions is received in the groove of the respective segment of the other of the housing portions in a mating relationship and the tongue on the respective segment of the other of the housing portions is received in the groove of the respective segment of the one of the housing portions in a mating relationship.

18. An exercise device comprising a housing including a pair of complementary diametrically-opposed housing portions, the housing having a weight means disposed therein and further having an opening formed therein substantially tangentially of the housing, the opening being bounded by an outer wall having a concave portion and an inner wall having a convex portion, whereby the hand of the user may be inserted through the opening in the housing, such that the user's hand is disposed between the inner and outer walls, such that at least the fingers of the user's hand rest substantially on the convex portion of the inner wall, the convex portion of the inner wall having a textured surface thereon for improved contact between the inner wall and at least the fingers of the user's hand such that the back of the user's hand rests substantially on the concave portion of the outer wall, whereby a forceful grip is not required by the user, and whereby the necessity for employing the user's conjunctive adjoining muscles is substantially reduced, thereby substantially reducing the tendency to detract from the development of the user's targeted muscle, and the weight means having a pair of opposite ends, each of which is secured to a respective housing portion.

19. An exercise device comprising a housing having a weight means disposed therein, the housing further having an opening formed therein substantially tangentially of the housing, the opening being bounded by an outer wall having a concave portion and an inner wall having a convex portion, whereby the hand of the user may be inserted through the opening in the housing, such that the user's hand is disposed between the inner and outer walls, such that at least the fingers of the user's hand rest substantially on the convex portion of the inner wall, and such that the back of the user's hand rests substantially on the concave portion of the outer wall, whereby a forceful grip is not required by the user, and whereby the necessity for employing the user's conjunctive adjoining muscles is substantially reduced, thereby substantially reducing the tendency to detract from the development of the user's targeted muscle, the housing portion including a pair of complementary semi-spherical housing portions having respective annular peripheral edges along which the housing portions mate, such that the peripheral edges of the housing portions mate with one another, forming an integral housing having a substantially smooth surface, the weight means having a pair of opposite ends, each of the opposite ends having a blind axial bore formed therein, a pair of cap screws, each cap screw being removably disposed through a respective housing portion and received in one of the respective blind axial bores formed in the opposite ends of the weight means, thereby removably securing the housing portions to the respective opposite ends of the weight means, and each cap screw having a cover removably mounted thereon such that the respective covers are substantially flush with the surface of the housing.

20. An exercise device comprising a substantially spherical housing including a pair of complementary housing portions joined together along a common midplane, the housing portions having an opening formed therebetween through which the hand of the user may be inserted, the opening being defined by a pair of walls in the device and including an inner wall and an outer wall, an insert means disposed in the opening between the inner wall and the outer wall, whereby the user's hand is in an "at rest" position and is substantially curved around the inner wall and is disposed within the insert means between the inner wall and the outer wall, respectively, the insert means substantially covering the user's hand during use of the device, thereby cushioning the user's hand and a weight disposed in the housing substantially at right angles to the common midplane between the housing portions, such that when the user's hand is inserted through the opening in the housing, the hand is at least partially disposed around the weight radially thereof, such that a forceful grip of the user's hand is not necessary, and such that the necessity for employing the user's conjunctive muscles is substantially reduced, thereby substantially reducing the tendency to detract from the development of the user's targeted muscle.

21. The exercise device of claim 20, wherein the insert means has a fabric cover fitted therein, the fabric cover disposed between the insert means and the user's hand such that the fabric cover may be removed for cleaning and replacement.

* * * * *